US011459649B2

(12) United States Patent
Takebe et al.

(10) Patent No.: US 11,459,649 B2
(45) Date of Patent: Oct. 4, 2022

(54) TITANIUM SHEET

(71) Applicant: NIPPON STEEL CORPORATION, Tokyo (JP)

(72) Inventors: Hidenori Takebe, Tokyo (JP); Kazuhiro Takahashi, Tokyo (JP); Hideki Fujii, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 22 days.

(21) Appl. No.: 16/634,834

(22) PCT Filed: Aug. 31, 2017

(86) PCT No.: PCT/JP2017/031403
§ 371 (c)(1),
(2) Date: Jan. 28, 2020

(87) PCT Pub. No.: WO2019/043882
PCT Pub. Date: Mar. 7, 2019

(65) Prior Publication Data

US 2020/0385848 A1 Dec. 10, 2020

(51) Int. Cl.
*C22F 1/18* (2006.01)
*C22C 14/00* (2006.01)

(52) U.S. Cl.
CPC ..... *C22F 1/183* (2013.01); *C22C 14/00* (2013.01)

(58) Field of Classification Search
None
See application file for complete search history.

(56) References Cited

U.S. PATENT DOCUMENTS

2018/0195154 A1* 7/2018 Otsuka ..... F01N 3/10
2018/0245185 A1* 8/2018 Takebe ..... C22F 1/183

FOREIGN PATENT DOCUMENTS

| | | | |
|---|---|---|---|
| CN | 102666892 | A | 9/2012 |
| JP | 2005-298970 | A | 10/2005 |
| JP | 4061211 | B2 | 3/2008 |
| JP | 4088183 | B2 | 5/2008 |
| JP | 4094395 | B2 | 6/2008 |

(Continued)

OTHER PUBLICATIONS

International Search Report for PCT/JP2017/031403 dated Nov. 21, 2017.

(Continued)

*Primary Examiner* — Elizabeth Collister
(74) *Attorney, Agent, or Firm* — Birch, Stewart, Kolasch & Birch, LLP

(57) ABSTRACT

A titanium sheet including the following chemical components in mass %: Cu: 0.70 to 1.50%, Cr: 0 to 0.40%, Mn: 0 to 0.50%, Si: 0.10 to 0.30%, O: 0 to 0.10%, Fe: 0 to 0.06%, N: 0 to 0.03%, C: 0 to 0.08%, H: 0 to 0.013%, elements except the above and Ti: 0 to 0.1% each, with a total amount of the elements being 0.3% or less, and the balance: Ti, wherein A value defined by Formula (1) is 1.15 to 2.5 mass %, and the titanium sheet having a metal microstructure in which an area fraction of an α phase is 95% or more, an area fraction of a β phase is 5% or less, and an area fraction of an intermetallic compound is 1% or less, wherein an average crystal grain size D (μm) of the α phase is 20 to 70 μm and satisfies Formula (2).

10 Claims, 4 Drawing Sheets

(56) References Cited

FOREIGN PATENT DOCUMENTS

| | | | |
|---|---|---|---|
| JP | 4157891 | B2 | 10/2008 |
| JP | 4157893 | B2 | 10/2008 |
| JP | 2009-68026 | A | 4/2009 |
| JP | 2010-31314 | A | 2/2010 |
| JP | 2010-121186 | A | 6/2010 |
| JP | 4486530 | B2 | 6/2010 |
| JP | 2010-202952 | A | 9/2010 |
| JP | 2010-242197 | A | 10/2010 |
| JP | WO2016/140231 | A1 | 4/2017 |

OTHER PUBLICATIONS

Office Action and Search Report issued in TW 106129961 dated Aug. 3, 2018.
Written Opinion of the International Searching Authority for PCT/JP2017/031403 (PCT/ISA/237) dated Nov. 21, 2017.
International Preliminary Report on Patentability and English translation of the Written Opinion of the International Searching Authority (Forms PCT/IB/326, PCT/IB/373 and PCT/ISA/237) for International Application No. PCT/JP2017/031403, dated Mar. 12, 2020.

* cited by examiner

TITANIUM SHEET

TECHNICAL FIELD

The present invention relates to a titanium sheet.

BACKGROUND ART

Titanium sheets have conventionally been used for many purposes such as heat exchangers, welded pipes, motorcycle exhaust systems such as mufflers, building materials, and so on. These days, there is an increasing need for improving the strength of titanium sheets so that these products can be thinned and reduced in weight. It is also desired that titanium sheets have high strength yet maintains formability so high that they can withstand the forming into a complicated shape. Currently, titanium Type 1 of JIS H4600 is used, and the strength issue is solved by an increase in its sheet thickness, but the increase in the sheet thickness disables the titanium sheet to fully exhibit the light-weight feature of titanium. In particular, in the use in a plate heat exchanger (PHE), it is press-formed into a complicated shape and accordingly needs to have sufficient formability. To meet this requirement, among titaniums, one excellent in formability is used.

PHE is desired to have improved heat exchange efficiency, for which the thinning is necessary. The thinning deteriorates formability and pressure resistance, and accordingly maintaining sufficient formability and improving strength are both required. Under such circumstances, to obtain a more excellent strength-formability balance than that of ordinary titanium, conventionally, studies have been made on the optimization of an O amount, an Fe amount, and so on and the control of crystal grain size, and temper rolling has been used.

For example, Patent Document 1 discloses a titanium sheet having an average crystal grain size of 30 μm or more. However, the titanium sheet of Patent Document 1 is poor in strength.

Patent Document 2 discloses a titanium alloy sheet whose O content is regulated, which contains Fe as a β stabilizing element, and whose α phase has an average crystal grain size of 10 μm or less. Patent Document 3 discloses a titanium alloy thin sheet with an average crystal grain size of 12 μm or less in which Cu is contained while Fe and O amounts are reduced and in which a $Ti_2Cu$ phase is precipitated to restrain the growth of crystal grains by a pinning effect. Patent Document 4 discloses a titanium alloy in which Cu is contained while its O content is reduced.

The techniques disclosed in Patent Documents 2 to 4 use the fact that titanium containing a large amount of alloy elements has fine crystal grains and tends to have high strength, and further maintain formability by reducing the O content and the Fe content. The techniques disclosed in these documents, however, do not achieve high strength while maintaining sufficient formability to such a degree as to meet the recent needs.

In contrast to the techniques disclosed in these documents, studies have been made on a technique capable of making crystal grains coarse while making alloy elements contained.

Patent Document 5 discloses a titanium alloy used for a cathode electrode for manufacturing an electrolytic copper foil and a method of manufacturing the same, the titanium alloy having a chemical composition that contains Cu and Ni, and having a crystal grain size which is adjusted to 5 to 50 μm by annealing in a temperature range of 600 to 850° C. Patent Document 6 discloses a titanium sheet for a drum for manufacturing an electrolytic Cu foil and a method of manufacturing the same, the titanium sheet having a chemical composition that contains Cu, Cr and small amounts of Fe and O. Patent Document 6 describes examples where annealing is performed at 630 to 870° C. Besides, in the technique described in Patent Document 6, the content of Fe is controlled low. In the case where a titanium sheet is manufactured using recycled scrap as a raw material, the content of Fe becomes high due to Fe in the scrap, which makes it difficult to manufacture a titanium sheet whose Fe content is controlled low. Accordingly, the manufacture of the titanium sheet described in Patent Document 6 through the recycling requires restrictions such as the use of scrap whose Fe content is low.

Patent Documents 7 and 8 each disclose a technique that controls an average crystal grain size of Si- and Al-containing titanium to 15 μm or more by decreasing a reduction ratio of cold rolling to 20% or less and increasing an annealing temperature to a condition of not lower than 825° C. nor higher than a β transformation temperature.

Further, Patent Document 9 describes a titanium alloy material for an exhaust system component excellent in oxidation resistance and formability, which is made up of Cu: 0.5 to 1.8%, Si: 0.1 to 0.6%, and oxygen: 0.1% or less, with the balance being Ti and inevitable impurities.

Patent Document 10 describes a heat-resistant titanium alloy sheet excellent in cold workability, which is made up of 0.3 to 1.8% Cu, 0.18% oxygen or less, and 0.30% Fe or less, with the balance being Ti and less than 0.3% inevitable impurities. Further, Patent Document 11 describes a titanium alloy sheet having high strength and excellent formability, in which the maximum crystal grain size of a β phase: 15 μm or less, an area ratio of an α phase: 80 to 97%, an average crystal grain size of the α phase: 20 μm or less, and a standard deviation of the crystal grain size of the α phase÷the average crystal grain size of the α phase×100 is 30% or less. Further, Patent Document 12 describes a thin titanium sheet which is made up of, in mass %, Cu: 0.1 to 1.0%, Ni: 0.01 to 0.20%, Fe: 0.01 to 0.10%, O: 0.01 to 0.10%, Cr: 0 to 0.20%, and the balance: Ti and inevitable impurities and has a chemical composition satisfying $0.04 \leq 0.3\ Cu+Ni \leq 0.44\%$, and in which an average crystal grain size of an α phase is 15 μm or more and an intermetallic compound of Cu and/or Ni with Ti has 2.0 vol % or less.

PRIOR ART DOCUMENT

Patent Document

Patent Document 1: Japanese Patent No. 4088183

Patent Document 2: Japanese Laid-open Patent Publication No. 2010-031314

Patent Document 3: Japanese Laid-open Patent Publication No. 2010-202952

Patent Document 4: Japanese Patent No. 4486530

Patent Document 5: Japanese Patent No. 4061211

Patent Document 6: Japanese Patent No. 4094395

Patent Document 7: Japanese Patent No. 4157891

Patent Document 8: Japanese Patent No. 4157893

Patent Document 9: Japanese Laid-open Patent Publication No. 2009-68026

Patent Document 10: Japanese Laid-open Patent Publication No. 2005-298970

Patent Document 11: Japanese Laid-open Patent Publication No. 2010-121186

Patent Document 12: WO2016/140231A1

DISCLOSURE OF THE INVENTION

Problems to be Solved by the Invention

A method for increasing strength uses alloying, the miniaturization of crystal grains, or working such as temper rolling. However, formability improvement is in a trade-off relation with strength increase. This makes it difficult to achieve high strength and sufficient formability. Even making the crystal grains fine or coarse by making the alloy elements contained as in the techniques disclosed in Patent Documents 2 to 11 cannot be said as achieving excellent formability corresponding to a fracture elongation of 42% or more and high strength corresponding to a proof stress of 200 MPa or more which are required of titanium sheets these days. Further, titanium inevitably contains some amount of oxygen, and an about 0.01 mass % fluctuation in an oxygen amount causes a great change in strength and formability and makes it impossible to obtain necessary strength and formability. It is technically very difficult and takes a lot of cost to strictly control the oxygen amount on an order of a trace amount of about 0.01 mass % when a titanium alloy sheet is manufactured.

Further, titanium sheets used as materials of structures such as automobiles often undergo welding. Accordingly, to obtain a product having stable properties, it is required to reduce strength decrease caused by grain size increase of a HAZ region accompanying the welding.

Therefore, it is an object of the present invention to provide a titanium sheet having an excellent balance of ductility and strength and capable of maintaining sufficient strength even after being welded.

Means for Solving the Problems

The gist of the present invention for solving the aforesaid problem is as follows.

(1)

A titanium sheet including the following chemical components in mass %:

Cu: 0.70 to 1.50%,

Cr: 0 to 0.40%,

Mn: 0 to 0.50%,

Si: 0.10 to 0.30%,

O: 0 to 0.10%,

Fe: 0 to 0.06%,

N: 0 to 0.03%,

C: 0 to 0.08%,

H: 0 to 0.013%, elements except the above and Ti: 0 to 0.1% each, with a total amount of the elements being 0.3% or less, and the balance: Ti, wherein A value defined by Formula (1) below is 1.15 to 2.5 mass %, and the titanium sheet having a metal microstructure in which an area fraction of an α phase is 95% or more, an area fraction of a β phase is 5% or less, and an area fraction of an intermetallic compound is 1% or less, wherein an average crystal grain size D (μm) of the α phase is 20 to 70 μm and satisfies Formula (2) below, $$A=[Cu]+0.98\,[Cr]+1.16\,[Mn]+3.4\,[Si] \quad \text{Formula (1)}$$

$$D\ [\mu m] \geq 0.8064 \times e^{45.588\,[O]} \quad \text{Formula (2),}$$

where e is the base of a natural logarithm.

(2)

The titanium sheet according to (1), wherein, in the metal microstructure, a total of the area fractions of the α phase, the β phase, and the intermetallic compound is 100%.

(3)

The titanium sheet according to (1) or (2), wherein the intermetallic compound includes a Ti—Si-based intermetallic compound and a Ti—Cu-based intermetallic compound.

(4)

The titanium sheet according to any one of (1) to (3), the titanium sheet having a sheet thickness of 0.3 to 1.5 mm and a 0.2% proof stress of 215 MPa or more, and having a fracture elongation of 42% or more in a state of a flat tensile specimen whose parallel region has a width of 6.25 mm, in which an original gauge length is 25 mm, and whose thickness is not changed from the sheet thickness.

Effect of the Invention

According to the present invention, it is possible to provide a titanium sheet having an excellent balance of ductility and strength and capable of maintaining sufficient strength even after being welded.

EMBODIMENTS FOR CARRYING OUT THE INVENTION

Figure 1:
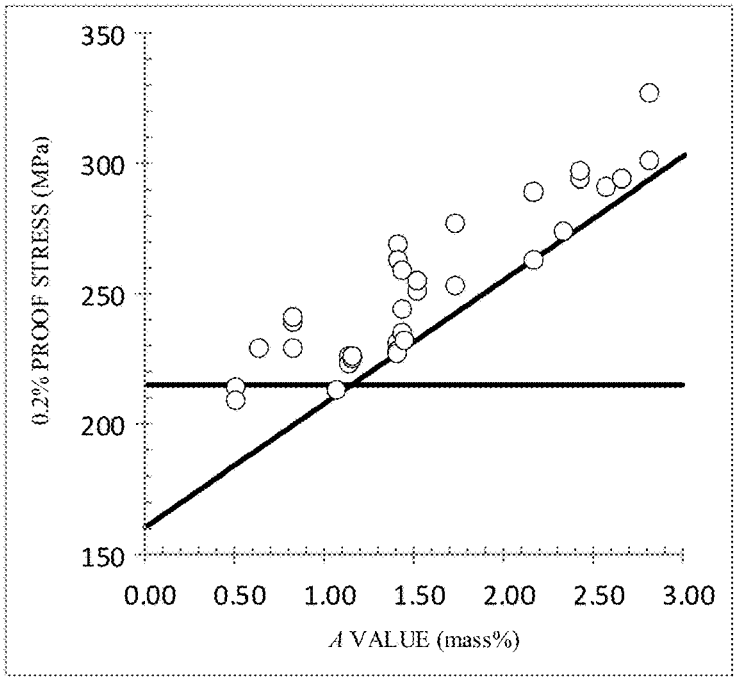
FIG. 1 is a graph illustrating a relation of A value and 0.2% proof stress.

The present inventor conducted studies on optimizing chemical components, a metal microstructure, and a crystal grain size of a titanium sheet to maintain formability while increasing strength and also maintain sufficient strength even after welding, thereby searching for a condition under which the titanium sheet has sufficient strength and formability and its strength decrease caused by grain size increase of its HAZ region accompanying the welding can be reduced. As a result, the present inventor succeeded in increasing the strength by adding predetermined amounts of Cu and Si as alloy elements to form an alloy, and in achieving all of strength, formability, and the inhibition of the strength decrease of the HAZ region on a high level by controlling the metal microstructure and the crystal grain size.

(Target Properties of Titanium Sheet of Present Invention)

0.2% proof stress: 215 MPa or more

The strength of a base metal of the titanium sheet of the present invention is set to 215 MPa or more in terms of 0.2% proof stress.

Fracture elongation: 42% or more

Further, a target fracture elongation of the base metal of the titanium sheet in a tensile test is 42% or more in view of formability. Fracture elongation is more desirably 45% or more. Its sheet thickness is 0.3 to 1.5 mm, and this fracture elongation is fracture elongation in a state of a flat tensile specimen whose parallel region has a width of 6.25 mm, in which an original gauge length is 25 mm, and whose thickness is not changed from the sheet thickness.

A strength decrease amount of a welded joint (development target value): 10 MPa or less If welding heat during the welding decreases the strength of the HAZ (Heat Affected Zone) region to increase a strength difference between the base metal and the HAZ region, deformation concentrates only on the HAZ region during the use, which is not preferable. Therefore, a target value of Δ0.2% proof stress which is a decrease amount of the strength of the welded joint from that of the base metal (development target value: (0.2% proof stress of the base metal)−(0.2% proof stress of the welded joint)) is set to 10 MPa or less.

(Chemical Components of Titanium Sheet)

Hereinafter, % for the chemical components means "mass %".

Cu: 0.70 to 1.50%

Cu greatly contributes to an increase in strength, and its solid solution amount in an α phase having an hcp structure forming titanium is large. However, the addition of too large an amount of Cu restrains the growth of crystal grains even if this amount is within a solid solution range, resulting in a decrease in elongation. Therefore, the content of Cu needs to be not less than 0.70% nor more than 1.50%. Its upper limit is desirably 1.45%, 1.40%, 1.35%, or 1.30% or less, and more desirably 1.20% or 1.10% or less. As for the lower limit, unless its addition amount is 0.70% or more, the necessary strength cannot be obtained in a case where neither of Cr nor Mn is contained besides Cu. For improving strength, its lower limit may be set to 0.75%, 0.80%, 0.85%, or 0.90%.

Si: 0.10 to 0.30%

Si contributes to an improvement in strength and therefore, 0.10% or more thereof is added. However, the addition of too large an amount of Si promotes the generation of a Ti—Si-based intermetallic compound to restrain the growth of the crystal grains, resulting in a decrease in elongation. In particular, as compared with Cu, Cr, Mn, and Ni, its addition even in a small mass has great effects of making the crystal grains fine and improving strength. Therefore, its addition amount is set to 0.30% or less. Note that the addition amount of Si also has an influence on ensuring strength after welding (inhibiting the HAZ region from becoming coarse). In order to reduce a decrease in proof stress in the HAZ region, the amount of Si is set to 0.10 to 0.30%. As needed, its lower limit may be set to 0.12%, 0.14%, or 0.16%, and its upper limit may be set to 0.28%, 0.26%, 0.24%, or 0.22%.

Cr: 0 to 0.40%

Cr is added as needed since it contributes to an improvement in strength. However, the addition of too large an amount of Cr promotes the generation of a β phase to restrain the growth of the crystal grains, resulting in a decrease in elongation. Therefore, its amount is set to 0.40% or less. It need not be contained where strength is fully increased by the addition of Cu, Mn, Si, and Ni. For improving strength, the lower limit of Cr may be 0.05% or 0.10%. However, it is not indispensable that Cr is contained, and its lower limit is 0%. As needed, its upper limit may be set to 0.35%, 0.30%, 0.25%, or 0.20%.

Mn: 0 to 0.50%

Mn is added as needed since it contributes to an improvement in strength. However, the addition of too large an amount of Mn promotes the generation of the β phase to restrain the growth of the crystal grains, resulting in a decrease in elongation. Therefore, its amount is set to 0.50% or less. It need not be contained where strength is fully increased by the addition of Cu, Cr, Si, and Ni. For improving strength, the lower limit of Mn may be set to 0.05% or 0.10%. However, it is not indispensable that Mn is contained, and its lower limit is 0%. As needed, its upper limit may be set to 0.40%, 0.30%, 0.25%, 0.15%, or 0.10%.

O: 0 to 0.10%

Oxygen (O) has a strong bonding force with Ti and is an impurity inevitably contained when metal Ti is industrially manufactured, but too large an amount of O results in high strength to deteriorate formability. Therefore, the amount of O needs to be controlled to 0.10% or less. O is contained as the impurity, and its lower limit need not be stipulated, and its lower limit is 0%. However, its lower limit may be set to 0.005%, 0.010%, 0.015%, 0.020%, or 0.030%. Its upper limit may be set to 0.090%, 0.080%, 0.070%, or 0.065%.

Fe: 0 to 0.06%

Iron (Fe) is an impurity inevitably contained when metal Ti is industrially manufactured, but too large an amount of Fe promotes the generation of the β phase to restrain the growth of the crystal grains. Therefore, the amount of iron is set to 0.06% or less. If its amount is 0.06% or less, its influence on 0.2% proof stress is negligibly small. Its amount is desirably 0.05% or less, and more desirably 0.04% or less. Fe is the impurity, and its lower limit is 0%. However, its lower limit may be set to 0.01%, 0.015%, 0.02%, or 0.03%.

N: 0 to 0.03%

Nitrogen (N) also promotes an increase in strength as much as or more than oxygen to deteriorate formability. However, since N is contained in a raw material in a smaller amount than O, its amount can be smaller than that of O. Therefore, its amount is set to 0.03% or less. Its amount is desirably 0.025% or less or 0.02% or less, and more desirably 0.015% or less or 0.01% or less. Incidentally, in many cases, 0.0001% N or more is contained at the time of the industrial manufacture, and its lower limit is 0%. Its lower limit may be set to 0.0001%, 0.001%, or 0.002%. Its upper limit may be set to 0.025% or 0.02%.

C: 0 to 0.08%

C promotes an increase in strength similarly to oxygen and nitrogen, but its effect is smaller than those of oxygen and nitrogen. This effect is half or less of that of oxygen, and if the content of C is 0.08% or less, its effect on 0.2% proof stress is negligible. However, since formability becomes more excellent as its content is smaller, its content is preferably 0.05% or less, and more preferably 0.03% or less, 0.02% or less, or 0.01%. The lower limit of the amount of C need not be stipulated, and its lower limit is 0%. As needed, its lower limit may be set to 0.001%.

H: 0 to 0.013%

Since H is an element causing embrittlement and its solubility limit at room temperatures is around 10 ppm, the content of H larger than the above results in the formation of a hydride, leading to a concern about embrittlement. If its content is 0.013% or less, it is usually in practical use without any problem though there is a concern about embrittlement. Further, since its content is smaller than the content of oxygen, its influence on 0.2% proof stress is negligible. Its content is preferably 0.010% or less, and more preferably 0.008% or less, 0.006% or less, 0.004% or less, or 0.003% or less. The lower limit of the amount of H need not be stipulated, and its lower limit is 0%. As needed, its lower limit may be set to 0.0001%.

Elements except the above and Ti: 0 to 0.1% each, with the total amount of these elements being 0.3% or less, and the balance: Ti The content of each impurity element contained besides Cu, Cr, Mn, Si, Fe, N, O, and H may be 0.10% or less, but the total content of these impurity elements, that is, the total amount of these is set to 0.3% or less. This setting is made because scrap is made use of, and is intended to prevent the excessive deterioration in formability because strength is increased owing to the sufficiently contained alloy elements. Elements possibly mixed are Al, Mo, V, Sn, Co, Zr, Nb, Ta, W, Hf, Pd, Ru, and so on. They are impurity elements and the lower limit of the amount of each of them is 0%. As needed, the upper limit of the amount of each of the impurity elements may be set to 0.08%, 0.06%, 0.04%, or 0.03%. The lower limit of their total amount is 0%. The upper limit of the total amount may be set to 0.25%, 0.20%, 0.15%, or 0.10%.

(A Value)

The titanium sheet of the present invention satisfies the above chemical components and its A value defined by Formula (1) below is 1.15 to 2.5 mass %.

$$A=[Cu]+0.98\,[Cr]+1.16\,[Mn]+3.4\,[Si] \quad \text{Formula (1)}$$

Figure 2:
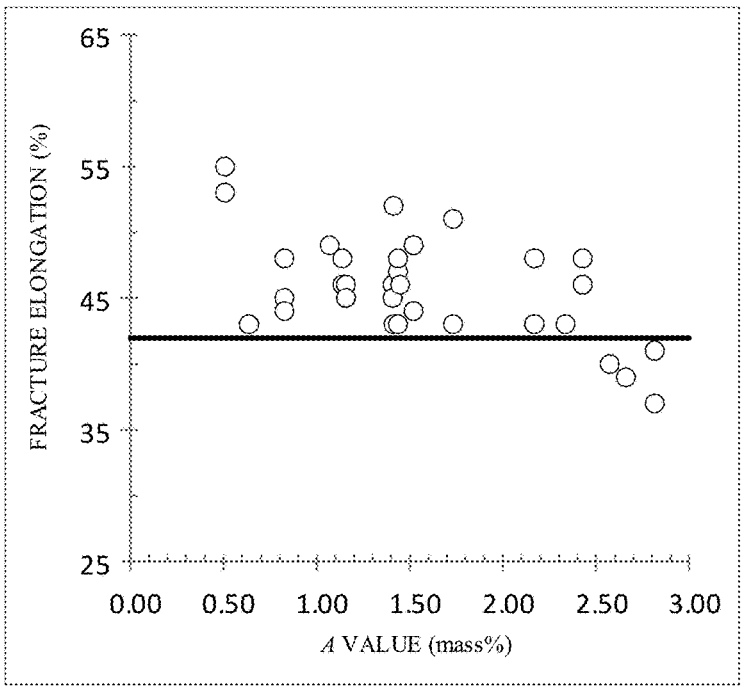
FIG. 2 is a graph illustrating a relation of A value and fracture elongation.

100 g Ti ingots containing Cu, Si, Mn, Cr within the chemical component ranges of the present invention were fabricated by vacuum arc remelting and were hot-rolled after being heated to 1100° C., and their surfaces were removed by cutting. Thereafter, they were cold-rolled in the same direction as that of the hot rolling to be made into thin sheets with a sheet thickness of 0.5 mm. Heat treatment was applied to the thin sheets under various conditions to adjust their crystal grain size. FIG. 1 illustrates a relation between A value and 0.2% proof stress. Further, FIG. 2 illustrates a relation of A value and elongation. Note that, in the plot points in FIGS. 1, 2, except A value, the metal microstructure and the average crystal grain size D of the α phase were all within the ranges of the present invention. That is, in these, the area fraction of the α phase was 95% or more, the area fraction of the β phase was 5% or less, the area fraction of the intermetallic compound was 1% or less, and the average crystal grain size D (μm) was 20 to 70 μm and thus satisfied Formula (2) to be described later.

Even if the contents of Cu, Si, Mn, and Cr are within the chemical component ranges of the present invention, strength decreases if A value is too small. In order for 0.2% proof stress not to be below 215 MPa, 1.15 mass % was set as the lower limit value of A value. For improving 0.2% proof stress, the lower limit of A value may be set to 1.20% or 1.25%. However, if A value is too large, elongation decreases, resulting in deteriorated workability. In order for fracture elongation not to be below 42%, 2.5 mass % was set as the upper limit value of A value. For improving fracture elongation, the upper limit of A value may be set to 2.40%, 2.30%, 2.20%, 2.10%, or 2.00%.

(Metal Microstructure)

In the titanium sheet of the present invention, the area fraction of the α phase is 95% or more, the area fraction of the β phase is 5% or less, and the area fraction of the intermetallic compound is 1% or less.

Figure 3:
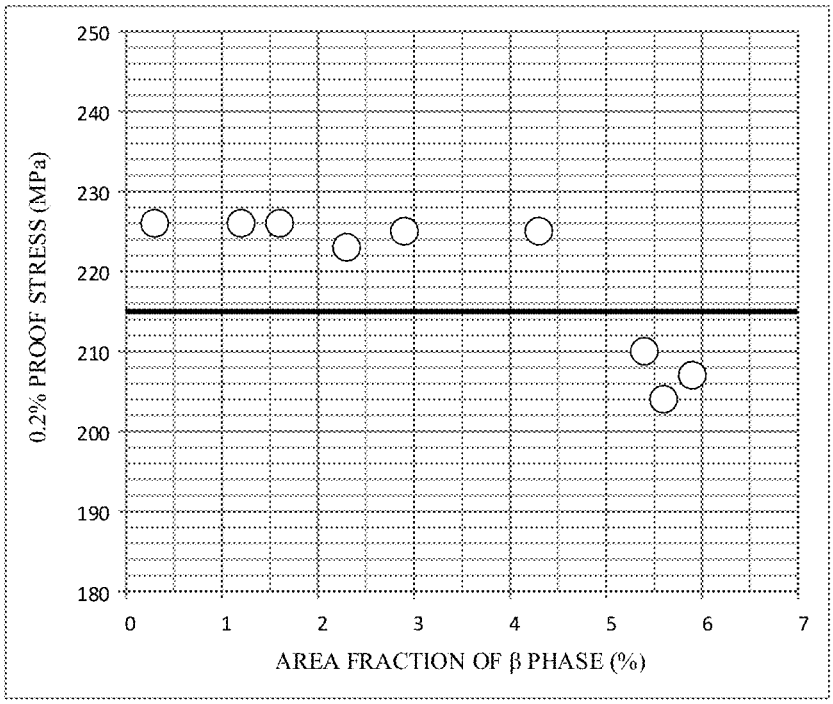
FIG. 3 is a graph illustrating a relation of an area fraction of a β phase and 0.2% proof stress.

FIG. 3 illustrates a relation of the area fraction of the β phase and 0.2% proof stress. Note that, in the plot points in FIG. 3, the metal microstructure except for the area fraction of the β phase, the average crystal grain size D of the α phase, the chemical component ranges, and A value are all within the ranges of the present invention. In order for 0.2% proof stress not to be below 215 MPa, the upper limit of the area fraction of the β phase was set to 5%. For improving 0.2% proof stress, the upper limit of the area fraction of the β phase may be set to 3%, 2%, 1%, 0.5%, or 0.1%.

Figure 4:
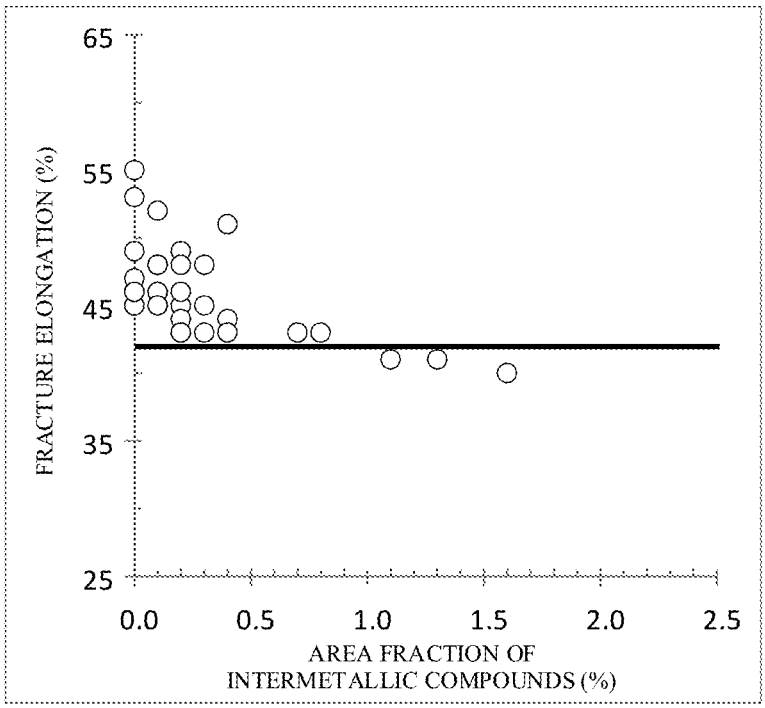
FIG. 4 is a graph illustrating a relation of an area fraction of intermetallic compound and elongation.

Further, FIG. 4 illustrates a relation of the area fraction of the intermetallic compound and fracture elongation. Note that, in the plot points in FIG. 4, the metal microstructure except for the area fraction of the intermetallic compound, the average crystal grain size D of the α phase, the chemical component ranges, and A value are all within the ranges of the present invention. In order for fracture elongation not to be below 42%, 1.0% was set as the upper limit value of the area fraction of the intermetallic compound. For improving fracture elongation, the upper limit of the area fraction of the intermetallic compound may be 0.8%, 0.6%, 0.4%, or 0.3%. The titanium sheet of the present invention does not have a microstructure other than the α phase, the β phase, and the intermetallic compound. As needed, the lower limit of the area ratio of the α phase may be set to 97%, 98%, 99%, or 99.5%.

Note that the metal microstructure other than the β phase and the intermetallic compound is the α phase, and the total area fraction of the α phase, the β phase, and the intermetallic compound is desirably 100%. The intermetallic compound includes a Ti—Cu-based intermetallic compound and a Ti—Si-based intermetallic compound. A typical Ti—Cu-based intermetallic compound is a $Ti_2Cu$, and typical Ti—Si-based intermetallic compounds are $Ti_3Si$ and $Ti_5Si_3$.

(Method of Measuring Metal Microstructure)

Figure 5:
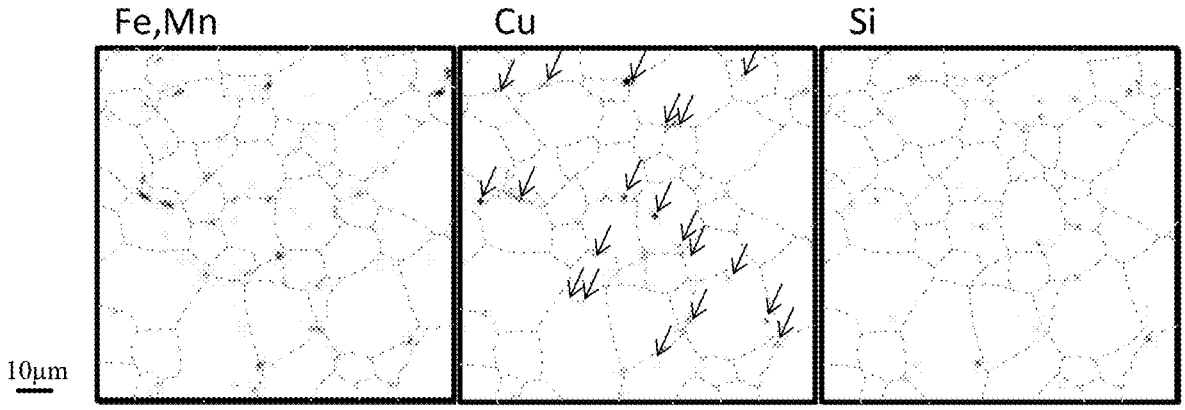
FIG. 5 is a schematic view of a Ti—Cu—Si—Mn component system when its region of about 100 μm×about 100 μm is EPMA-analyzed.

For measuring the area fractions of the α phase, the β phase, and the intermetallic compounds, their area ratios are found by SEM observation and EPMA analysis. When a reflected electron image (composition image) is observed in the SEM observation, the Ti—Si-based intermetallic compound appears black. Since the Ti—Cu-based intermetallic compound and the 0 phase appear white, they need to be separated. For this purpose, plane analysis by EPMA is performed for Si, Cu, and Fe in one field of view (corresponding to 200 μm×200 μm) at a magnification of ×500 under an acceleration voltage of 15 kV, and in the case where Cr and Mn are contained, the same is performed for Cr and Mn. Note that the field of view to be observed is not limited to one field of view, and the observation may be performed in a plurality of fields of view whose total area corresponds to 200 μm×200 μm, and an average may be found. Fe, Cr, and Mn are concentrated in the β phase but not concentrated in the Ti—Cu-based intermetallic compound. Therefore, by comparing the reflected electron image and the element distribution, it is possible to separate and identify the white regions. Thereafter, the area ratios in the reflected electron image are measured and the measurement results are defined as their area fractions. A measurement surface of a measurement specimen may be mirror-finished with diamond particles, and C or Au may be vapor-deposited thereon to provide electrical conductivity. FIG. 5 illustrates a schematic view of a Ti—Cu—Si—Mn component system when its region of about 100 μm×about 100 μm is EPMA-analyzed. Positions where the elements are concentrated are expressed with gray to black. Further, the broken lines in the drawing represent grain boundaries of the microstructures. Fe and Mn are concentrated at the same positions and are present on the grain boundaries and in the grains. Cu is partly concentrated at the same positions as Fe and Mn, but Cu is also present at a different place from the places where Fe and Mn are present and this is the Ti—Cu-based intermetallic compound. Si is mostly present at different places from the places where Fe, Mn, and Cu are present. Accordingly, by measuring the area fraction of the places (arrow regions) where Fe and Mn are not concentrated out of the concentration positions of Cu, it is possible to find the area ratio of the intermetallic compound. Specifically, a region with 0.2% Fe or more is regarded as the β phase, and out of regions with less than 0.2% Fe, a region with 5% Cu or more is regarded as the Ti—Cu-based intermetallic compound, and a region with 1% Si or more is regarded as the Ti—Si-based intermetallic compound. The area ratios of the regions thus obtained through the separation are found.

(Crystal Grain Size)

Figure 6:
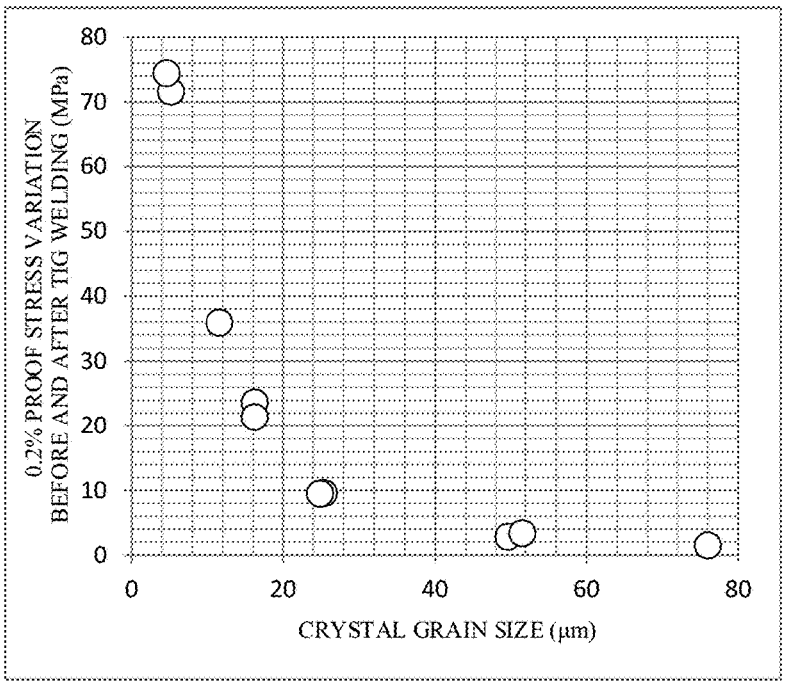
FIG. 6 is a graph illustrating a relation of an average crystal grain size D (μm) of an α phase and a variation in 0.2% proof stress between a TIG welded joint and a base metal.

The average crystal grain size D of the α phase (μm): 20 to 70 μm FIG. 6 illustrates a relation of the average crystal grain size D (μm) of the α phase and Δ0.2% proof stress which is a variation in 0.2% proof stress before and after TIG welding (=(0.2% proof stress of the base metal)−(0.2% proof stress of the welded joint)). Note that, in the plot points in FIG. 6, except for the average crystal grain size of the α phase, the chemical component ranges (except for oxygen (O)) and A value are all within the ranges of the present invention. Specifically, they were fabricated by melting a Ti-1.01% Cu-0.19% Si-0.03% Fe component system under a varied oxygen amount, and hot-rolling, cold-rolling, and annealing the resultants into thin sheets with a sheet thickness of 0.5 mm. The crystal grain size was adjusted by variously changing a heat treatment condition. As for the microstructure, in all of these, no β phase was present and the area fraction of the intermetallic compounds was also 1% or less. The fabricated thin sheets were TIG-welded and tensile specimens of the welded joints were taken out, with each weld bead located at a center region of a parallel region of the tensile specimen. At the time of the TIG welding, NSSW Ti28 (corresponding to JIS Z3331 STi0100J) manufactured by Nippon Steel & Sumikin Welding Co., Ltd. was used. The welding was performed under the conditions of current: 50 Å, voltage: 15 V, and speed: 80 cm/min. The tensile specimens are each in the shape of a flat tensile specimen whose parallel region has a width of 6.25 mm, in which an original gauge length is 25 mm, and whose thickness is not changed from the sheet thickness. However, since the sheets were warped during the welding, they were subjected to shape correction and annealed at 550° C. for 30 min for the removal of strain caused by the shape correction. It was confirmed that this annealing did not cause any change in the grain size. A strain rate was 0.5%/min until the strain amount reached 1%, and thereafter was 30%/min up to fracture.

With the average crystal grain size D of the α phase being less than 20 μm, Δ0.2% proof stress has a large value of 10 MPa or more. On the other hand, with the average crystal grain size D of the α phase being over 70 μm, the grain size becomes too large, which may cause wrinkles or steps at the time of forming Therefore, the average crystal grain size D of the α phase is set to 20 to 70 μm. As needed, the lower limit of the average crystal grain size D of the α phase may be set to 23 μm, 25 μm, or 28 μm, and its upper limit may be set to 60 μm, 55 μm, 50 μm, or 45 μm.

(Relation of Oxygen Amount and Average Crystal Grain Size D of α Phase)

Figure 7:
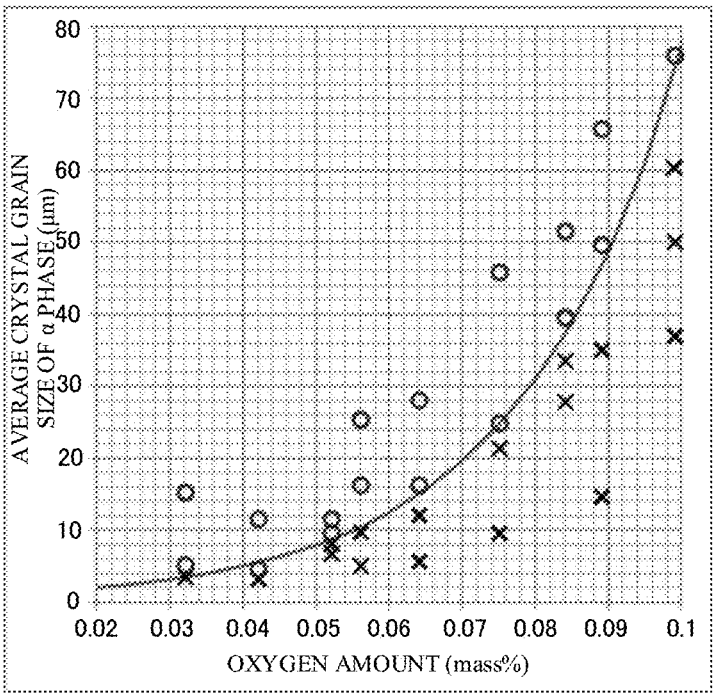
FIG. 7 is a graph illustrating a relation of an oxygen amount, the average crystal grain size D of the α phase, and the fracture elongation of the base metal.

Further, when a tensile test was conducted on specimens taken out of the base metals and a relation of the oxygen amount and the average crystal grain size D of the α phase, and fracture elongation were examined, the result in FIG. 7 was obtained. In FIG. 7, ○: fracture elongation is 42% or more, X: fracture elongation is less than 42%, and solid line: Formula (2). In a range not below Formula (2) represented by the curve in FIG. 7, fracture elongation was 42% or more. Therefore, Formula (2) was set as the condition.

$$D\ [\mu m] \geq 0.8064 \times e^{45.588\ [O]} \qquad \text{Formula (2)}$$

where e is the base of a natural logarithm (Influence of Si Addition Amount on Decrease Amount of Strength of Weld Zone from Strength of Base Metal)

The titanium sheet of the present invention contains Si: 0.10 to 0.30% as described above, and the addition amount of Si also has an influence on ensuring the strength of the welded joint (inhibiting the HAZ region from becoming coarse). When the titanium sheet is welded, temperature distribution is formed from a molten region to the base metal region, and there are continuously formed [1] the molten region and a region turned into an acicular microstructure by being heated to a β transformation temperature or higher or to nearly the β transformation temperature, [2] a region where the grain growth of the α phase is restrained due to the mixed presence of the α phase and the β phase, [3] a region where the β phase and the α phase become coarse, and [4] a region where the intermetallic compounds precipitate. In the region [1], a texture becomes random or granular, O, N, and so on are absorbed during the welding, and accordingly, strength is slightly higher than in the base metal region. In the region [2] and the region [4], the grain growth of the α phase is restrained by the β phase or the intermetallic compounds and thus the crystal grain size about equal to that of the base metal region is kept, and there is no great strength difference from the base metal. On the other hand, in the region [3], the α phase becomes coarse, so that strength decreases according to the Hall-Petch rule. Accordingly, in a welded joint tensile test, a specimen having a narrow width of about 6.25 mm fractures especially in the region [3] which becomes coarse, of the HAZ region.

Figure 8:
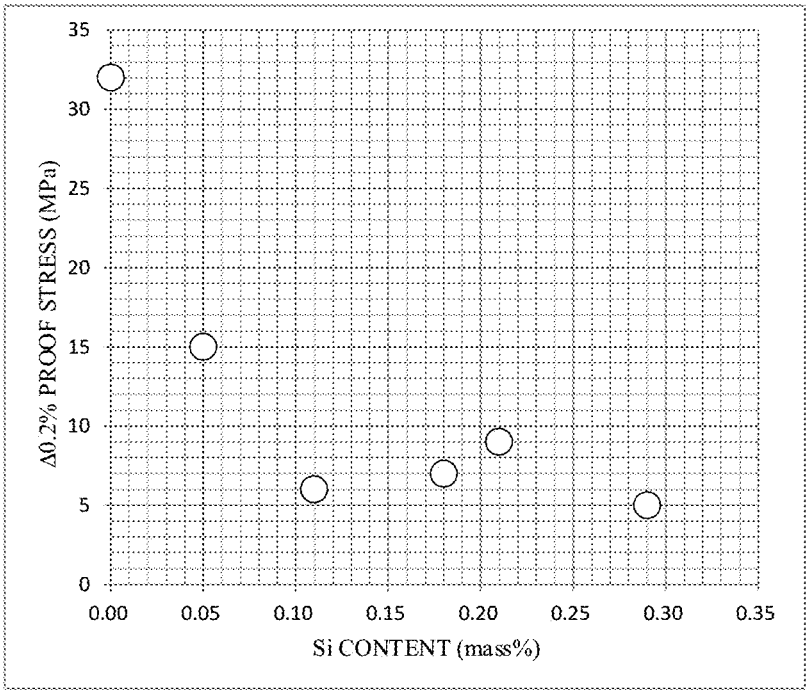
FIG. 8 is a graph illustrating a relation of a Si amount and Δ0.2% proof stress which is a proof stress decrease amount before and after TIG welding in a region [3], of a HAZ region, where grains become coarse.

FIG. 8 is a graph illustrating a relation of the Si amount and Δ0.2% proof stress which is a difference between 0.2% proof stress of the TIG welded joint including the region [3], of the HAZ region, which becomes coarse and 0.2% proof stress of the base metal (=(0.2% proof stress of the base metal)−(0.2% proof stress of the welded joint)). 100 g ingots containing Cu, Si, Cr, and Mn were fabricated by vacuum arc remelting, and were hot-rolled after being heated to 1100° C., and their surfaces were removed by cutting. Thereafter, they were cold-rolled in the same direction as that of the hot rolling to be made into thin sheets with a sheet thickness of 0.5 mm. Heat treatment was applied to the thin sheets under various conditions to adjust the average crystal grain size to about 20 to 30 μm. Note that, in the plot points in FIG. 8, the chemical component ranges except for the Si amount, A value, and the average crystal grain size D of the α phase were all within the ranges of the present invention. The area fraction of the intermetallic compounds was less than 1%, and the area fraction of the β phase was less than 3%. TIG welding and a tensile test were performed by the same methods as those in the case of the above crystal grain size, and it turned out that, with 0.10% Si or more, a decrease in strength after the welding was reduced to 10 MPa or less. Therefore, 0.10% Si or more needs to be contained. In order to reduce the decrease in strength after the welding, the lower limit of the Si amount may be set to 0.14%, 0.17%, or 0.20%.

(Example of Manufacturing Method)

It is possible to manufacture the titanium sheet of the present invention by hot-rolling and cold-rolling a Ti ingot satisfying the aforesaid chemical components and A value and setting a condition of annealing following the cold rolling to a predetermined condition. As needed, temper rolling may be performed after the annealing following the cold rolling. Manufacturing conditions will be described in detail below.

(Condition of Hot Rolling)

In the hot rolling, an ingot manufactured by an ordinary method such as VAR (vacuum arc remelting), EBR (electron beam remelting), plasma arc melting, or the like is used. If it is rectangular, it may be hot-rolled as it is. Otherwise, it is formed into a rectangular shape by forging or bloom rolling. A rectangular slab thus obtained is hot-rolled at 800 to 1000° C. and with a reduction ratio of 50% or more, which are ordinary hot rolling temperature and reduction ratio.

(Condition of Cold Rolling)

Before the cold rolling, strain relief annealing and ordinary descaling are performed. The strain relief annealing (intermediate annealing) does not necessarily have to be performed, and its temperature and time are not limited. Ordinarily, the strain relief annealing is performed at a temperature lower than the β transformation temperature and specifically is performed at a temperature lower than the β transformation temperature by 30° C. The β transformation temperature of the alloy system of the present invention is within a range of 860 to 900° C. though differing depending on the alloy composition, and accordingly, the strain relief annealing temperature is desirably around 800° C. in the present invention. A method of the descaling is not limited and may be shot blast, acid pickling, machine cutting, or the like. However, insufficient descaling may lead to a crack during the cold rolling. Note that the cold rolling of the hot-rolled sheet is performed with a reduction ratio of 50% or more as usual.

(Condition of Annealing)

In the annealing following the cold rolling, it is necessary to first perform low-temperature batch annealing and then perform high-temperature continuous annealing A different method, for example, one-time annealing (high-temperature or low-temperature batch or continuous annealing) cannot produce the microstructure of the present invention and cannot achieve the target properties. Further, even two-time annealing cannot produce the microstructure of the present invention and cannot achieve the target properties unless it is the method including the low-temperature batch annealing followed by the high-temperature continuous annealing Here, the purpose of the low-temperature batch annealing is the solid solution of Cu and the grain growth of the α phase. In the batch annealing, a heating rate in a coil is not uniform, and in order to reduce the nonuniformity in the coil, the annealing needs to be performed for 8 h or longer. In order to prevent the bonding of the coil, the annealing needs to be performed at 730° or lower. Further, in a low-temperature range, the Ti—Cu-based intermetallic compound and the Ti—Si-based intermetallic compound preticipate. Therefore, in order to prevent the growth of these intermetallic compounds, the upper limit of the annealing temperature is limited, and in order to enable the solid solution of Cu and the grain growth of the α phase, it is necessary to limit the lower limit of the annealing temperature. Therefore, the annealing temperature is set to 700 to 730° C.

(Condition of High-temperature Annealing)

In order to reduce the intermetallic compounds precipitated in the low-temperature batch annealing, a high-temperature range is retained for at least 10 seconds or more in the high-temperature annealing. The retention temperature is set to 780 to 820° C. If the retention time is long, a hardened layer becomes thick, and therefore the retention time is set to 2 min at longest. Since the batch annealing cannot be such short-time annealing, the continuous annealing has to be performed. The high-temperature continuous annealing is capable of reducing the area fraction of the Ti—Si-based intermetallic compound, but since the Ti—Si-based intermetallic compound quickly precipitates, a cooling rate after the high-temperature continuous annealing is set to 5°/s or more from the retention temperature up to 550° C.

EXAMPLES 300 g Ti ingots No. 1 to No. 97, which are listed in Tables 1 to 3, containing Cu, Si, Mn, and Cr were fabricated by vacuum arc remelting and were hot-rolled after being heated to 1100° C., and their surfaces were removed by cutting. Thereafter, they were cold-rolled in the same direction as that of the hot rolling to be made into thin sheets with a sheet thickness of 0.5 mm. The thin sheets (No. 1 to No. 97) were annealed under various conditions described in Tables 4 to 6 (the first annealing is indicated by "ANNEALING 1" and the next annealing is indicated by "ANNEALING 2"). In the annealing, in cases where cooling was FC (furnace cooling), batch (vacuum) annealing (indicated by "BATCH" in Tables 4 to 6) was performed, and in the other cases, continuous (Ar gas) annealing (indicated by "CONTINUOUS" in Tables 4 to 6) was performed. In the batch annealing, by simulating coil production, two sheets were laid on each other to be annealed. Only in the cases where the batch annealing was performed, whether or not the two sheets after the annealing got bonded together was checked. In evaluation, cases where the two sheets could be unstuck from each other without accompanied by great deformation are marked with ○, cases where they deformed but could be unstuck from each other are marked with Δ, and cases where they could not be unstuck from each other are marked with X. In the cases where the deformation was found in the checking of whether or not they got bonded together, the deformation was bending deformation starting from a joint region. Incidentally, in the cases where the batch annealing was not performed, "-" is entered in the column of "BONDING IN BATCH". Those for which "-" is entered in all the columns of ANNEALING 2 were not subjected to the annealing 2.

Incidentally, those where the bonding occurred were not subjected to evaluation regarding TIG welding and so on, and were only subjected to a tensile test and the measurement of an average crystal grain size. Further, regarding the sheets which underwent up to the annealing 2, their surface states were checked and a level equivalent to that of a currently actually mass-produced material is evaluated as ○, and a level too low for shipment as a product is evaluated as X ("indicated by "SURFACE STATE"). Further, a spherical stretch forming test using a Teflon (registered trademark) sheet with a thickness of 50 μm as a lubricant was performed until a dome height reached 15 mm, and an exterior wrinkle occurrence degree was observed. Those having no rough skin are marked with ○, and those having rough skin are marked with X (indicated by "SURFACE AFTER WORKING").

The fabricated thin sheets were TIG-welded and tensile specimens were taken out, with each weld bead located at the center of a parallel region. At the time of the TIG welding, NNSW Ti-28 (corresponding to JIS Z3331 STi0100J) which is a product manufactured by Nippon Steel & Sumikin Welding Co., Ltd. was used in consideration of general versatility. Welding conditions are current: 50 Å, voltage: 15 V, and speed: 80 cm/min. The tensile specimens are each in the shape of a flat tensile specimen whose parallel region has a width of 6.25 mm, in which an original gauge length is 25 mm, and whose thickness is not changed from the sheet thickness. However, since the sheets were warped during the welding, they were subjected to shape correction and annealed at 550° C. for 30 min for the removal of strain caused by the shape correction (no change in the average crystal grain size). The strain rate was 0.5%/min until the strain amount reached 1%, and thereafter was 30%/min up to fracture. Incidentally, the TIG welding and the tensile test after the welding were conducted on some of them. Cases where a 0.2% proof stress difference before and after the TIG welding (indicated by Δ0.2% PROOF STRESS (MPa)) was 10 MPa or less were evaluated as accepted. Tables 7 to 9 show the average crystal grain size D of the α phase (indicated by GRAIN SIZE (μm)), the area fraction of the α phase (indicated by α PHASE RATIO (%)), the area fraction of the β phase (indicated by β PHASE RATIO (%)), the area fraction of the intermetallic compounds (indicated by INTERMETALLIC COMPOUND (%)), 0.2% proof stress (indicated by PROOF STRESS (MPa)), fracture elongation (indicated by ELONGATION (%)), appearance (indicated by SURFACE STATE), a value of $0.8064\times e^{45.588[O]}$ (the right side of Formula (2): indicated by "FORMULA (2) (μm)"), and the determination result regarding Formula (2) (indicated by "DETERMINATION ON FORMULA (2) (μm)": cases where the value of $D-0.8064\times e^{45.588[O]}$ is minus are marked with "X", and cases where this value is 0 or more are marked with "○"), which were found for the thin sheets of No. 1 to No. 97, and the classification of the present invention and comparative example.

Nos. 1, 34 to 37, 60 to 62, 80, 86 to 97 in which the chemical component ranges, A value, the metal microstructure, and the average crystal grain size D of the α phase are all within the ranges of the present invention (present invention example) satisfied all of 0.2% proof stress: 215 MPa or more, fracture elongation: 42% or more, and the strength decrease amount of the welded joint: 10 MPa or less.

The results of the others (comparative examples) are as follows.

In No. 2, A value was less than 1.15 mass % and 0.2% proof stress was low. Further, due to the addition of no Si, the strength decrease of the welded joint was large.

In No. 3, due to the addition of no Si, the strength decrease of the welded joint was large.

In No. 4, A value was less than 1.15% and 0.2% proof stress was low. Incidentally, the small strength decrease of the welded joint is ascribable to the large average crystal grain size D of the α phase of the base metal.

In No. 5, the average crystal grain size D of the α phase of the base metal was over 70 μm and its surface got wrinkled when it was worked. Incidentally, owing to the large grain size D, 0.2% proof stress was low even though A value was 1.15 or more. Incidentally, the small strength decrease of the welded joint is ascribable to the large average crystal grain size D of the α phase of the base metal.

In No. 6, A value was less than 1.15 mass % and 0.2% proof stress was low. Further, due to the addition of no Si, the strength decrease of the welded joint was large.

In No. 7, due to the addition of no Si, the strength decrease of the welded joint was large.

In No. 8, A value was less than 1.15 mass % and 0.2% proof stress was low. Further, due to the addition of no Si, the strength decrease of the welded joint was large.

In No. 9, due to the addition of no Si, the strength decrease of the welded joint was large.

In No. 10, A value was less than 1.15 mass % and 0.2% proof stress was low. Further, due to the addition of no Si, the strength decrease of the welded joint was large.

In No. 11, due to the addition of no Si, the strength decrease of the welded joint was large.

In No. 12, A value was less than 1.15 mass % and 0.2% proof stress was low. Further, due to the addition of no Si, the strength decrease of the welded joint was large.

In No. 13, due to the addition of no Si, the strength decrease of the welded joint was large.

In Nos. 14, 15, due to too low an annealing temperature, the average crystal grain size D of the α phase was less than 20 μm and fracture elongation was small.

In Nos. 16, 17, the two sheets got bonded together due to the annealing and could not be unstuck from each other. Therefore, they were not subjected to the tensile test.

In Nos. 18, 19, due to too low an annealing temperature, the average crystal grain size D of the α phase was less than 20 μm and fracture elongation was small.

In Nos. 20, 21, due to the long-time annealing in a high-temperature range, fracture elongation was small.

In Nos. 22 to 29, the average crystal grain size D of the α phase did not satisfy Formula (2), fracture elongation was small, and the strength decrease of the welded joint was also large. Further, in Nos. 22 to 25, due to too low an annealing temperature, the average crystal grain size D of the α phase was less than 20 μm, and the area fraction of the intermetallic compounds was also high.

In Nos. 30 to 33, the average crystal grain size D of the α phase was less than 20 μm and fracture elongation was small. Further, the strength decrease of the welded joint was large.

In Nos. 38, 39, due to too low an annealing temperature and due to the furnace cooling, the average crystal grain size D of the α phase was less than 20 μm, and the area fraction of the intermetallic compounds was also high.

In Nos. 40, 41, due to the high annealing temperature, the two sheets got bonded together and could not be unstuck from each other. Therefore, they were not subjected to the tensile test.

In Nos. 42, 43, due to too low an annealing temperature and due to the furnace cooling, the average crystal grain size D of the α phase was less than 20 μm, and the area fraction of the intermetallic compounds was also high.

In Nos. 44, 45, the average crystal grain size D of the α phase did not satisfy Formula (2) and fracture elongation was small.

In Nos. 46 to 49, due to too low an annealing temperature and due to the furnace cooling, the average crystal grain size D of the α phase was less than 20 μm, and the area fraction of the intermetallic compounds was also high.

In Nos. 50, 51, the average crystal grain size D of the α phase of the base metal was over 70 μm, their surfaces got wrinkled when they were worked, and 0.2% proof stress was low. Further, due to the addition of no Si, the strength decrease of the welded joint was large.

In Nos. 52, 53, the average crystal grain size D of the α phase was less than 20 μm, and due to the addition of no Si, the strength decrease of the welded joint was large.

In Nos. 54 to 56, due to the addition of no Si, the strength decrease of the welded joint was large.

In Nos. 57 to 59, the average crystal grain size D of the α phase was less than 20 μm, and due to the addition of no Si, the strength decrease of the welded joint was large.

In No. 63, the average crystal grain size D of the α phase did not satisfy Formula (2), and fracture elongation was small.

In No. 64, the average crystal grain size D of the α phase was less than 20 μm, and fracture elongation was small.

In No. 65, the average crystal grain size D of the α phase did not satisfy Formula (2), and fracture elongation was small.

In Nos. 66, 67, the average crystal grain size D of the α phase was less than 20 μm, and fracture elongation was small.

In No. 68, due to too high an annealing temperature, the two sheets got bonded together and could not be unstuck from each other. Therefore, they were not subjected to the tensile test.

In No. 69, A value was less than 1.15 mass %, and 0.2% proof stress was low.

In Nos. 70, 71, due to the addition of no Si, the strength decrease of the welded joint was large.

In Nos. 72 to 75, the average crystal grain size D of the α phase was less than 20 μm, and the strength decrease of the welded joint was large.

In Nos. 76 to 79, the area fraction of the intermetallic compounds was over 1%, and fracture elongation was small.

In No. 81, the average crystal grain size D of the α phase was less than 20 μm, and fracture elongation was small.

In Nos. 82, 83, due to the low cooling rate of the batch annealing, the area fraction of the intermetallic compounds was over 1%, and fracture elongation was small. Further, the appearance was inferior.

In No. 84, a seizure occurred in the batch annealing, and the appearance was inferior.

In No. 85, due to the high continuous annealing temperature, the area fraction of the β phase was over 5%, and fracture elongation was small.

TABLE 1

| | CHEMICAL COMPOSITION (mass %) | | | | | | | | | | |
|---|---|---|---|---|---|---|---|---|---|---|---|
| No. | Cu | Cr | Mn | Si | Fe | O | N | C | H | OTHER METAL | A VALI |
| 1 | 0.88 | 0.15 | 0.10 | 0.17 | 0.03 | 0.054 | 0.023 | 0.011 | 0.001 | 0.00 | 1.72 |
| 2 | 0.82 | 0.00 | 0.00 | 0.00 | 0.06 | 0.08 | 0.006 | 0.007 | 0.002 | Ni: 0.10 | 0.82 |
| 3 | 1.00 | 0.20 | 0.00 | 0.00 | 0.05 | 0.08 | 0.011 | 0.006 | 0.002 | Ni: 0.10 | 1.20 |
| 4 | 0.82 | 0.10 | 0.00 | 0.00 | 0.06 | 0.08 | 0.011 | 0.005 | 0.0017 | Ni: 0.10 | 0.92 |
| 5 | 1.18 | 0.00 | 0.00 | 0.00 | 0.06 | 0.07 | 0.009 | 0.013 | 0.0027 | Ni: 0.05 | 1.18 |
| 6 | 0.82 | 0.00 | 0.00 | 0.00 | 0.06 | 0.08 | 0.006 | 0.007 | 0.002 | Ni: 0.10 | 0.82 |
| 7 | 1.00 | 0.20 | 0.00 | 0.00 | 0.05 | 0.08 | 0.011 | 0.006 | 0.002 | Ni: 0.10 | 1.20 |
| 8 | 0.82 | 0.10 | 0.00 | 0.00 | 0.06 | 0.08 | 0.011 | 0.005 | 0.0017 | Ni: 0.10 | 0.92 |
| 9 | 1.18 | 0.00 | 0.00 | 0.00 | 0.06 | 0.07 | 0.009 | 0.013 | 0.0027 | Ni: 0.05 | 1.18 |
| 10 | 0.82 | 0.00 | 0.00 | 0.00 | 0.06 | 0.08 | 0.006 | 0.007 | 0.002 | Ni: 0.10 | 0.82 |
| 11 | 1.00 | 0.20 | 0.00 | 0.00 | 0.05 | 0.08 | 0.011 | 0.006 | 0.002 | Ni: 0.10 | 1.20 |
| 12 | 0.82 | 0.10 | 0.00 | 0.00 | 0.06 | 0.08 | 0.011 | 0.005 | 0.0017 | Ni: 0.10 | 0.92 |
| 13 | 1.18 | 0.00 | 0.00 | 0.00 | 0.06 | 0.07 | 0.009 | 0.013 | 0.0027 | Ni: 0.05 | 1.18 |
| 14 | 0.82 | 0.00 | 0.00 | 0.00 | 0.06 | 0.08 | 0.006 | 0.007 | 0.002 | Ni: 0.10 | 0.82 |
| 15 | 1.00 | 0.20 | 0.00 | 0.00 | 0.05 | 0.08 | 0.011 | 0.006 | 0.002 | Ni: 0.10 | 1.20 |
| 16 | 0.82 | 0.10 | 0.00 | 0.00 | 0.06 | 0.08 | 0.011 | 0.005 | 0.0017 | Ni: 0.10 | 0.92 |
| 17 | 1.18 | 0.00 | 0.00 | 0.00 | 0.06 | 0.07 | 0.009 | 0.013 | 0.0027 | Ni: 0.05 | 1.18 |
| 18 | 0.82 | 0.00 | 0.00 | 0.00 | 0.06 | 0.08 | 0.006 | 0.007 | 0.002 | Ni: 0.10 | 0.82 |
| 19 | 1.00 | 0.20 | 0.00 | 0.00 | 0.05 | 0.08 | 0.011 | 0.006 | 0.002 | Ni: 0.10 | 1.20 |
| 20 | 0.82 | 0.10 | 0.00 | 0.00 | 0.06 | 0.08 | 0.011 | 0.005 | 0.0017 | Ni: 0.10 | 0.92 |
| 21 | 1.18 | 0.00 | 0.00 | 0.00 | 0.06 | 0.07 | 0.009 | 0.013 | 0.0027 | Ni: 0.05 | 1.18 |
| 22 | 0.82 | 0.00 | 0.00 | 0.00 | 0.06 | 0.08 | 0.006 | 0.007 | 0.002 | Ni: 0.10 | 0.82 |
| 23 | 1.00 | 0.20 | 0.00 | 0.00 | 0.05 | 0.08 | 0.011 | 0.006 | 0.002 | Ni: 0.10 | 1.20 |
| 24 | 0.82 | 0.10 | 0.00 | 0.00 | 0.06 | 0.08 | 0.011 | 0.005 | 0.0017 | Ni: 0.10 | 0.92 |
| 25 | 1.18 | 0.00 | 0.00 | 0.00 | 0.06 | 0.07 | 0.009 | 0.013 | 0.0027 | Ni: 0.05 | 1.18 |
| 26 | 0.82 | 0.00 | 0.00 | 0.20 | 0.06 | 0.081 | 0.009 | 0.006 | 0.002 | Ni: 0.09 | 1.50 |
| 27 | 1.00 | 0.21 | 0.00 | 0.19 | 0.05 | 0.083 | 0.016 | 0.009 | 0.001 | Ni: 0.10 | 1.85 |
| 28 | 0.83 | 0.11 | 0.00 | 0.21 | 0.06 | 0.079 | 0.013 | 0.008 | 0.001 | Ni: 0.08 | 1.65 |
| 29 | 1.19 | 0.00 | 0.00 | 0.20 | 0.06 | 0.072 | 0.018 | 0.011 | 0.002 | Ni: 0.05 | 1.87 |
| 30 | 0.82 | 0.00 | 0.00 | 0.20 | 0.06 | 0.081 | 0.009 | 0.006 | 0.002 | Ni: 0.09 | 1.50 |

TABLE 2

| | CHEMICAL COMPOSITION (mass %) | | | | | | | | | | |
|---|---|---|---|---|---|---|---|---|---|---|---|
| No. | Cu | Cr | Mn | Si | Fe | O | N | C | H | OTHER METAL | A VALI |
| 31 | 1.00 | 0.21 | 0.00 | 0.19 | 0.05 | 0.083 | 0.016 | 0.009 | 0.001 | Ni: 0.10 | 1.85 |
| 32 | 0.83 | 0.11 | 0.00 | 0.21 | 0.06 | 0.079 | 0.013 | 0.008 | 0.001 | Ni: 0.08 | 1.65 |
| 33 | 1.19 | 0.00 | 0.00 | 0.20 | 0.06 | 0.072 | 0.018 | 0.011 | 0.002 | Ni: 0.05 | 1.87 |
| 34 | 0.82 | 0.00 | 0.00 | 0.20 | 0.06 | 0.081 | 0.009 | 0.006 | 0.002 | Ni: 0.09 | 1.50 |
| 35 | 1.00 | 0.21 | 0.00 | 0.19 | 0.05 | 0.083 | 0.016 | 0.009 | 0.001 | Ni: 0.10 | 1.85 |
| 36 | 0.83 | 0.11 | 0.00 | 0.21 | 0.06 | 0.079 | 0.013 | 0.008 | 0.001 | Ni: 0.08 | 1.65 |
| 37 | 1.19 | 0.00 | 0.00 | 0.20 | 0.06 | 0.072 | 0.018 | 0.011 | 0.002 | Ni: 0.05 | 1.87 |
| 38 | 0.82 | 0.00 | 0.00 | 0.20 | 0.06 | 0.081 | 0.009 | 0.006 | 0.002 | Ni: 0.09 | 1.50 |
| 39 | 1.00 | 0.21 | 0.00 | 0.19 | 0.05 | 0.083 | 0.016 | 0.009 | 0.001 | Ni: 0.10 | 1.85 |
| 40 | 0.83 | 0.11 | 0.00 | 0.21 | 0.06 | 0.079 | 0.013 | 0.008 | 0.001 | Ni: 0.08 | 1.65 |
| 41 | 1.19 | 0.00 | 0.00 | 0.20 | 0.06 | 0.072 | 0.018 | 0.011 | 0.002 | Ni: 0.05 | 1.87 |
| 42 | 0.82 | 0.00 | 0.00 | 0.20 | 0.06 | 0.081 | 0.009 | 0.006 | 0.002 | Ni: 0.09 | 1.50 |
| 43 | 1.00 | 0.21 | 0.00 | 0.19 | 0.05 | 0.083 | 0.016 | 0.009 | 0.001 | Ni: 0.10 | 1.85 |
| 44 | 0.83 | 0.11 | 0.00 | 0.21 | 0.06 | 0.079 | 0.013 | 0.008 | 0.001 | Ni: 0.08 | 1.65 |
| 45 | 1.19 | 0.00 | 0.00 | 0.20 | 0.06 | 0.072 | 0.018 | 0.011 | 0.002 | Ni: 0.05 | 1.87 |
| 46 | 0.82 | 0.00 | 0.00 | 0.20 | 0.06 | 0.081 | 0.009 | 0.006 | 0.002 | Ni: 0.09 | 1.50 |

TABLE 2-continued

| No. | CHEMICAL COMPOSITION (mass %) | | | | | | | | | | |
|---|---|---|---|---|---|---|---|---|---|---|---|
| | Cu | Cr | Mn | Si | Fe | O | N | C | H | OTHER METAL | A VALI |
| 47 | 1.00 | 0.21 | 0.00 | 0.19 | 0.05 | 0.083 | 0.016 | 0.009 | 0.001 | Ni: 0.10 | 1.85 |
| 48 | 0.83 | 0.11 | 0.00 | 0.21 | 0.06 | 0.079 | 0.013 | 0.008 | 0.001 | Ni: 0.08 | 1.65 |
| 49 | 1.19 | 0.00 | 0.00 | 0.20 | 0.06 | 0.072 | 0.018 | 0.011 | 0.002 | Ni: 0.05 | 1.87 |
| 50 | 1.10 | 0.40 | 0.00 | 0.00 | 0.02 | 0.030 | 0.014 | 0.005 | 0.002 | 0.00 | 1.49 |
| 51 | 1.10 | 0.40 | 0.00 | 0.00 | 0.02 | 0.030 | 0.014 | 0.005 | 0.002 | 0.00 | 1.49 |
| 52 | 1.10 | 0.40 | 0.00 | 0.00 | 0.02 | 0.030 | 0.014 | 0.005 | 0.002 | 0.00 | 1.49 |
| 53 | 1.10 | 0.40 | 0.00 | 0.00 | 0.02 | 0.030 | 0.014 | 0.005 | 0.002 | 0.00 | 1.49 |
| 54 | 1.10 | 0.40 | 0.00 | 0.00 | 0.02 | 0.030 | 0.014 | 0.005 | 0.002 | 0.00 | 1.49 |
| 55 | 1.10 | 0.40 | 0.00 | 0.00 | 0.02 | 0.030 | 0.014 | 0.005 | 0.002 | 0.00 | 1.49 |
| 56 | 1.10 | 0.40 | 0.00 | 0.00 | 0.02 | 0.030 | 0.014 | 0.005 | 0.002 | 0.00 | 1.49 |
| 57 | 0.80 | 0.00 | 0.00 | 0.00 | 0.05 | 0.084 | 0.004 | 0.005 | 0.0032 | 0.00 | 0.80 |
| 58 | 1.00 | 0.33 | 0.00 | 0.00 | 0.04 | 0.072 | 0.005 | 0.012 | 0.0008 | 0.00 | 1.32 |
| 59 | 1.00 | 0.20 | 0.00 | 0.00 | 0.04 | 0.073 | 0.019 | 0.005 | 0.0027 | 0.00 | 1.20 |
| 60 | 0.80 | 0.00 | 0.00 | 0.11 | 0.05 | 0.081 | 0.007 | 0.005 | 0.0025 | 0.00 | 1.17 |

TABLE 3

| No. | CHEMICAL COMPOSITION (mass %) | | | | | | | | | | |
|---|---|---|---|---|---|---|---|---|---|---|---|
| | Cu | Cr | Mn | Si | Fe | O | N | C | H | OTHER METAL | A VA |
| 61 | 1.00 | 0.33 | 0.00 | 0.12 | 0.04 | 0.072 | 0.013 | 0.009 | 0.0013 | 0.00 | 1.73 |
| 62 | 1.00 | 0.20 | 0.00 | 0.10 | 0.04 | 0.074 | 0.025 | 0.003 | 0.0029 | 0.00 | 1.54 |
| 63 | 0.80 | 0.00 | 0.00 | 0.11 | 0.05 | 0.081 | 0.007 | 0.005 | 0.0025 | 0.00 | 1.17 |
| 64 | 1.00 | 0.33 | 0.00 | 0.12 | 0.04 | 0.072 | 0.013 | 0.009 | 0.0013 | 0.00 | 1.73 |
| 65 | 1.00 | 0.20 | 0.00 | 0.10 | 0.04 | 0.074 | 0.025 | 0.003 | 0.0029 | 0.00 | 1.54 |
| 66 | 0.80 | 0.00 | 0.00 | 0.11 | 0.05 | 0.081 | 0.007 | 0.005 | 0.0025 | 0.00 | 1.17 |
| 67 | 1.00 | 0.33 | 0.00 | 0.12 | 0.04 | 0.072 | 0.013 | 0.009 | 0.0013 | 0.00 | 1.73 |
| 68 | 1.00 | 0.20 | 0.00 | 0.10 | 0.04 | 0.074 | 0.025 | 0.003 | 0.0029 | 0.00 | 1.54 |
| 69 | 0.80 | 0.00 | 0.00 | 0.00 | 0.05 | 0.084 | 0.004 | 0.005 | 0.0032 | 0.00 | 0.80 |
| 70 | 1.00 | 0.33 | 0.00 | 0.00 | 0.04 | 0.072 | 0.005 | 0.012 | 0.0008 | 0.00 | 1.32 |
| 71 | 1.00 | 0.20 | 0.00 | 0.00 | 0.04 | 0.073 | 0.019 | 0.005 | 0.0027 | 0.00 | 1.20 |
| 72 | 1.20 | 0.00 | 0.00 | 0.30 | 0.04 | 0.042 | 0.023 | 0.008 | 0.001 | 0.00 | 2.22 |
| 73 | 1.30 | 0.00 | 0.00 | 0.30 | 0.03 | 0.054 | 0.021 | 0.010 | 0.001 | 0.00 | 2.32 |
| 74 | 1.20 | 0.00 | 0.00 | 0.30 | 0.04 | 0.042 | 0.023 | 0.008 | 0.001 | 0.00 | 2.22 |
| 75 | 1.30 | 0.00 | 0.00 | 0.30 | 0.03 | 0.054 | 0.021 | 0.010 | 0.001 | 0.00 | 2.32 |
| 76 | 1.20 | 0.00 | 0.00 | 0.30 | 0.04 | 0.042 | 0.023 | 0.008 | 0.001 | 0.00 | 2.22 |
| 77 | 1.30 | 0.00 | 0.00 | 0.30 | 0.03 | 0.054 | 0.021 | 0.010 | 0.001 | 0.00 | 2.32 |
| 78 | 1.20 | 0.00 | 0.00 | 0.30 | 0.04 | 0.042 | 0.023 | 0.008 | 0.001 | 0.00 | 2.22 |
| 79 | 1.30 | 0.00 | 0.00 | 0.30 | 0.03 | 0.054 | 0.021 | 0.010 | 0.001 | 0.00 | 2.32 |
| 80 | 1.20 | 0.00 | 0.00 | 0.30 | 0.04 | 0.042 | 0.023 | 0.008 | 0.001 | 0.00 | 2.22 |
| 81 | 1.30 | 0.00 | 0.00 | 0.30 | 0.03 | 0.054 | 0.021 | 0.010 | 0.001 | 0.00 | 2.32 |
| 82 | 1.30 | 0.00 | 0.00 | 0.30 | 0.03 | 0.054 | 0.021 | 0.010 | 0.001 | 0.00 | 2.32 |
| 83 | 1.30 | 0.00 | 0.00 | 0.30 | 0.03 | 0.054 | 0.021 | 0.010 | 0.001 | 0.00 | 2.32 |
| 84 | 1.30 | 0.00 | 0.00 | 0.30 | 0.03 | 0.054 | 0.021 | 0.010 | 0.001 | 0.00 | 2.32 |
| 85 | 1.00 | 0.21 | 0.00 | 0.19 | 0.05 | 0.083 | 0.006 | 0.008 | 0.001 | Ni: 0.10 | 1.85 |
| 86 | 0.98 | 0.00 | 0.00 | 0.15 | 0.03 | 0.046 | 0.015 | 0.007 | 0.001 | Mo: 0.08 | 1.49 |
| 87 | 1.02 | 0.00 | 0.05 | 0.16 | 0.03 | 0.058 | 0.003 | 0.009 | 0.001 | Nb: 0.07 | 1.62 |
| 88 | 1.12 | 0.00 | 0.10 | 0.13 | 0.03 | 0.061 | 0.006 | 0.007 | 0.001 | Zr: 0.08 | 1.68 |
| 89 | 0.94 | 0.00 | 0.07 | 0.17 | 0.03 | 0.059 | 0.013 | 0.005 | 0.002 | V: 0.09 | 1.60 |
| 90 | 0.88 | 0.00 | 0.00 | 0.22 | 0.03 | 0.057 | 0.018 | 0.013 | 0.003 | W: 0.08 | 1.61 |
| 91 | 1.06 | 0.00 | 0.00 | 0.16 | 0.04 | 0.061 | 0.011 | 0.005 | 0.001 | Hf: 0.08 | 1.60 |
| 92 | 1.05 | 0.00 | 0.00 | 0.14 | 0.04 | 0.060 | 0.008 | 0.006 | 0.002 | Al: 0.07 | 1.53 |
| 93 | 0.78 | 0.00 | 0.00 | 0.21 | 0.03 | 0.065 | 0.006 | 0.004 | 0.002 | Co: 0.07 | 1.49 |
| 94 | 0.75 | 0.00 | 0.00 | 0.19 | 0.05 | 0.060 | 0.006 | 0.004 | 0.002 | Sn: 0.09 | 1.40 |
| 95 | 0.94 | 0.00 | 0.00 | 0.22 | 0.03 | 0.053 | 0.009 | 0.003 | 0.002 | Ta: 0.07 | 1.69 |
| 96 | 1.32 | 0.00 | 0.43 | 0.15 | 0.03 | 0.051 | 0.006 | 0.005 | 0.002 | 0.00 | 2.33 |
| 97 | 1.40 | 0.11 | 0.11 | 0.15 | 0.01 | 0.023 | 0.005 | 0.008 | 0.002 | 0.00 | 2.15 |

TABLE 4

| No. | ANNEALING 1 | | | | |
|---|---|---|---|---|---|
| | HEATING RATE | TEMPERATURE/ ° C. | TIME | COOLING | METHOD |
| 1 | 0.1° C./s | 700 | 8 h | FC | BATCH |
| 2 | 5° C./s | 790 | 2 min | 8° C./s | CONTINUOUS |
| 3 | 5° C./s | 790 | 2 min | 8° C./s | CONTINUOUS |
| 4 | 5° C./s | 790 | 30 min | 8° C./s | CONTINUOUS |
| 5 | 5° C./s | 790 | 30 min | 8° C./s | CONTINUOUS |

TABLE 4-continued

| | | | | | |
|---|---|---|---|---|---|
| 6 | 0.1° C./s | 700 | 8 h | FC | BATCH |
| 7 | 0.1° C./s | 700 | 8 h | FC | BATCH |
| 8 | 0.1° C./s | 700 | 8 h | FC | BATCH |
| 9 | 0.1° C./s | 700 | 8 h | FC | BATCH |
| 10 | 5° C./s | 700 | 2 min | 8° C./s | CONTINUOUS |
| 11 | 5° C./s | 700 | 2 min | 8° C./s | CONTINUOUS |
| 12 | 5° C./s | 700 | 2 min | 8° C./s | CONTINUOUS |
| 13 | 5° C./s | 700 | 2 min | 8° C./s | CONTINUOUS |
| 14 | 0.1° C./s | 630 | 8 h | FC | BATCH |
| 15 | 0.1° C./s | 630 | 24 h | FC | BATCH |
| 16 | 0.1° C./s | 840 | 8 h | FC | BATCH |
| 17 | 0.1° C./s | 840 | 8 h | FC | BATCH |
| 18 | 0.1° C./s | 580 | 6 h | FC | BATCH |
| 19 | 0.1° C./s | 580 | 24 h | FC | BATCH |
| 20 | 5° C./s | 780 | 30 min | 8° C./s | CONTINUOUS |
| 21 | 5° C./s | 780 | 30 min | 8° C./s | CONTINUOUS |
| 22 | 0.1° C./s | 600 | 10 h | FC | BATCH |
| 23 | 0.1° C./s | 600 | 10 h | FC | BATCH |
| 24 | 0.1° C./s | 600 | 10 h | FC | BATCH |
| 25 | 0.1° C./s | 600 | 10 h | FC | BATCH |
| 26 | 5° C./s | 790 | 2 min | 8° C./s | CONTINUOUS |
| 27 | 5° C./s | 790 | 2 min | 8° C./s | CONTINUOUS |
| 28 | 5° C./s | 790 | 30 min | 8° C./s | CONTINUOUS |
| 29 | 5° C./s | 790 | 30 min | 8° C./s | CONTINUOUS |
| 30 | 5° C./s | 700 | 2 min | 8° C./s | CONTINUOUS |

| | ANNEALING 2 | | | | |
|---|---|---|---|---|---|
| No. | HEATING RATE | TEMPERATURE/ ° C. | TIME | COOLING | METHOD |
| 1 | 5° C./s | 800 | 2 min | 8° C./s | CONTINUOUS |
| 2 | — | — | — | — | — |
| 3 | — | — | — | — | — |
| 4 | — | — | — | — | — |
| 5 | — | — | — | — | — |
| 6 | 5° C./s | 800 | 2 min | 8° C./s | CONTINUOUS |
| 7 | 5° C./s | 800 | 2 min | 8° C./s | CONTINUOUS |
| 8 | 5° C./s | 800 | 1 min | 8° C./s | CONTINUOUS |
| 9 | 5° C./s | 800 | 1 min | 8° C./s | CONTINUOUS |
| 10 | 5° C./s | 800 | 2 min | 8° C./s | CONTINUOUS |
| 11 | 5° C./s | 800 | 2 min | 8° C./s | CONTINUOUS |
| 12 | 5° C./s | 850 | 2 min | 8° C./s | CONTINUOUS |
| 13 | 5° C./s | 850 | 2 min | 8° C./s | CONTINUOUS |
| 14 | — | — | — | — | — |
| 15 | — | — | — | — | — |
| 16 | — | — | — | — | — |
| 17 | — | — | — | — | — |
| 18 | — | — | — | — | — |
| 19 | — | — | — | — | — |
| 20 | — | — | — | — | — |
| 21 | — | — | — | — | — |
| 22 | — | — | — | — | — |
| 23 | — | — | — | — | — |
| 24 | — | — | — | — | — |
| 25 | — | — | — | — | — |
| 26 | — | — | — | — | — |
| 27 | — | — | — | — | — |
| 28 | — | — | — | — | — |
| 29 | — | — | — | — | — |
| 30 | 5° C./s | 800 | 2 min | 8° C./s | CONTINUOUS |

TABLE 5

| | ANNEALING 1 | | | | |
|---|---|---|---|---|---|
| No. | HEATING RATE | TEMPERATURE/ ° C. | TIME | COOLING | METHOD |
| 31 | 5° C./s | 700 | 2 min | 8° C./s | CONTINUOUS |
| 32 | 5° C./s | 700 | 2 min | 8° C./s | CONTINUOUS |
| 33 | 5° C./s | 700 | 2 min | 8° C./s | CONTINUOUS |
| 34 | 0.1° C./s | 700 | 16 h | FC | BATCH |
| 35 | 0.1° C./s | 700 | 16 h | FC | BATCH |
| 36 | 0.1° C./s | 700 | 16 h | FC | BATCH |
| 37 | 0.1° C./s | 700 | 16 h | FC | BATCH |
| 38 | 0.1° C./s | 630 | 8 h | FC | BATCH |

TABLE 5-continued

| | | | | | |
|---|---|---|---|---|---|
| 39 | 0.1° C./s | 630 | 24 h | FC | BATCH |
| 40 | 0.1° C./s | 840 | 8 h | FC | BATCH |
| 41 | 0.1° C./s | 840 | 8 h | FC | BATCH |
| 42 | 0.1° C./s | 580 | 6 h | FC | BATCH |
| 43 | 0.1° C./s | 580 | 24 h | FC | BATCH |
| 44 | 5° C./s | 780 | 30 min | 8° C./s | CONTINUOUS |
| 45 | 5° C./s | 780 | 30 min | 8° C./s | CONTINUOUS |
| 46 | 0.1° C./s | 600 | 10 h | FC | BATCH |
| 47 | 0.1° C./s | 600 | 10 h | FC | BATCH |
| 48 | 0.1° C./s | 600 | 10 h | FC | BATCH |
| 49 | 0.1° C./s | 600 | 10 h | FC | BATCH |
| 50 | 0.1° C./s | 730 | 10 h | FC | BATCH |
| 51 | 0.1° C./s | 730 | 10 h | FC | BATCH |
| 52 | 5° C./s | 900 | 2 min | 8° C./s | CONTINUOUS |
| 53 | 5° C./s | 850 | 2 min | 8° C./s | CONTINUOUS |
| 54 | 5° C./s | 700 | 2 min | 8° C./s | CONTINUOUS |
| 55 | 5° C./s | 700 | 2 min | 8° C./s | CONTINUOUS |
| 56 | 0.1° C./s | 700 | 8 h | FC | BATCH |
| 57 | 0.1° C./s | 680 | 4 h | FC | BATCH |
| 58 | 0.1° C./s | 680 | 4 h | FC | BATCH |
| 59 | 0.1° C./s | 680 | 4 h | FC | BATCH |
| 60 | 0.1° C./s | 700 | 16 h | FC | BATCH |

| | ANNEALING 2 | | | | |
|---|---|---|---|---|---|
| No. | HEATING RATE | TEMPERATURE/ ° C. | TIME | COOLING | METHOD |
| 31 | 5° C./s | 800 | 2 min | 8° C./s | CONTINUOUS |
| 32 | 5° C./s | 850 | 2 min | 8° C./s | CONTINUOUS |
| 33 | 5° C./s | 850 | 2 min | 8° C./s | CONTINUOUS |
| 34 | 5° C./s | 800 | 2 min | 8° C./s | CONTINUOUS |
| 35 | 5° C./s | 800 | 2 min | 8° C./s | CONTINUOUS |
| 36 | 5° C./s | 800 | 2 min | 8° C./s | CONTINUOUS |
| 37 | 5° C./s | 800 | 2 min | 8° C./s | CONTINUOUS |
| 38 | — | — | — | — | — |
| 39 | — | — | — | — | — |
| 40 | — | — | — | — | — |
| 41 | — | — | — | — | — |
| 42 | — | — | — | — | — |
| 43 | — | — | — | — | — |
| 44 | — | — | — | — | — |
| 45 | — | — | — | — | — |
| 46 | — | — | — | — | — |
| 47 | — | — | — | — | — |
| 48 | — | — | — | — | — |
| 49 | — | — | — | — | — |
| 50 | 5° C./s | 720 | 2 min | 8° C./s | CONTINUOUS |
| 51 | 0.1° C./s | 720 | 10 h | FC | BATCH |
| 52 | 5° C./s | 800 | 2 min | 8° C./s | CONTINUOUS |
| 53 | 5° C./s | 800 | 2 min | 8° C./s | CONTINUOUS |
| 54 | 5° C./s | 760 | 2 min | 8° C./s | CONTINUOUS |
| 55 | 5° C./s | 800 | 2 min | 8° C./s | CONTINUOUS |
| 56 | 5° C./s | 800 | 2 min | 8° C./s | CONTINUOUS |
| 57 | — | — | — | — | — |
| 58 | — | — | — | — | — |
| 59 | — | — | — | — | — |
| 60 | 5° C./s | 800 | 2 min | 8° C./s | CONTINUOUS |

TABLE 6

| | ANNEALING 1 | | | | | ANNEALING 2 |
|---|---|---|---|---|---|---|
| No. | HEATING RATE | TEMPERATURE/ ° C. | TIME | COOLING | METHOD | HEATING RATE |
| 61 | 0.1° C./s | 700 | 16 h | FC | BATCH | 5° C./s |
| 62 | 0.1° C./s | 700 | 16 h | FC | BATCH | 5° C./s |
| 63 | 5° C./s | 850 | 2 min | 8° C./s | CONTINUOUS | 5° C./s |
| 64 | 5° C./s | 700 | 2 min | 8° C./s | CONTINUOUS | 5° C./s |
| 65 | 5° C./s | 700 | 2 min | 8° C./s | CONTINUOUS | 5° C./s |
| 66 | 0.1° C./s | 630 | 8 h | FC | BATCH | — |
| 67 | 0.1° C./s | 630 | 24 h | FC | BATCH | — |
| 68 | 0.1° C./s | 840 | 8 h | FC | BATCH | — |
| 69 | 0.1° C./s | 700 | 16 h | FC | BATCH | 5° C./s |
| 70 | 0.1° C./s | 700 | 16 h | FC | BATCH | 5° C./s |
| 71 | 0.1° C./s | 700 | 16 h | FC | BATCH | 5° C./s |

TABLE 6-continued

| | | | | | | |
|---|---|---|---|---|---|---|
| 72 | 5° C./s | 790 | 2 min | 8° C./s | CONTINUOUS | — |
| 73 | 5° C./s | 790 | 2 min | 8° C./s | CONTINUOUS | — |
| 74 | 5° C./s | 850 | 2 min | 8° C./s | CONTINUOUS | 5° C./s |
| 75 | 5° C./s | 700 | 2 min | 8° C./s | CONTINUOUS | 5° C./s |
| 76 | 5° C./s | 800 | 2 min | 8° C./s | CONTINUOUS | 0.1° C./s |
| 77 | 5° C./s | 800 | 2 min | 8° C./s | CONTINUOUS | 0.1° C./s |
| 78 | 0.1° C./s | 730 | 10 h | FC | BATCH | 0.1° C./s |
| 79 | 0.1° C./s | 730 | 10 h | FC | BATCH | 0.1° C./s |
| 80 | 0.1° C./s | 700 | 16 h | FC | BATCH | 5° C./s |
| 81 | 0.1° C./s | 640 | 8 h | FC | BATCH | 5° C./s |
| 82 | 5° C./s | 730 | 1 h | 8° C./s | CONTINUOUS | 0.1° C./s |
| 83 | 5° C./s | 720 | 4 h | 8° C./s | CONTINUOUS | 0.1° C./s |
| 84 | 0.1° C./s | 740 | 8 h | FC | BATCH | 5° C./s |
| 85 | 0.1° C./s | 700 | 16 h | FC | BATCH | 5° C./s |
| 86 | 0.1° C./s | 700 | 8 h | FC | BATCH | 5° C./s |
| 87 | 0.1° C./s | 700 | 8 h | FC | BATCH | 5° C./s |
| 88 | 0.1° C./s | 700 | 8 h | FC | BATCH | 5° C./s |
| 89 | 0.1° C./s | 700 | 8 h | FC | BATCH | 5° C./s |
| 90 | 0.1° C./s | 700 | 8 h | FC | BATCH | 5° C./s |
| 91 | 0.1° C./s | 700 | 8 h | FC | BATCH | 5° C./s |
| 92 | 0.1° C./s | 700 | 8 h | FC | BATCH | 5° C./s |
| 93 | 0.1° C./s | 700 | 8 h | FC | BATCH | 5° C./s |
| 94 | 0.1° C./s | 700 | 8 h | FC | BATCH | 5° C./s |
| 95 | 0.1° C./s | 700 | 8 h | FC | BATCH | 5° C./s |
| 96 | 0.1° C./s | 700 | 16 h | FC | BATCH | 5° C./s |
| 97 | 0.1° C./s | 700 | 16 h | FC | BATCH | 5° C./s |

| | ANNEALING 2 | | | |
|---|---|---|---|---|
| No. | TEMPERATURE/ ° C. | TIME | COOLING | METHOD |
| 61 | 800 | 2 min | 8° C./s | CONTINUOUS |
| 62 | 800 | 2 min | 8° C./s | CONTINUOUS |
| 63 | 800 | 2 min | 8° C./s | CONTINUOUS |
| 64 | 760 | 2 min | 8° C./s | CONTINUOUS |
| 65 | 800 | 2 min | 8° C./s | CONTINUOUS |
| 66 | — | — | — | — |
| 67 | — | — | — | — |
| 68 | — | — | — | — |
| 69 | 800 | 2 min | 8° C./s | CONTINUOUS |
| 70 | 800 | 2 min | 8° C./s | CONTINUOUS |
| 71 | 800 | 2 min | 8° C./s | CONTINUOUS |
| 72 | — | — | — | — |
| 73 | — | — | — | — |
| 74 | 800 | 2 min | 8° C./s | CONTINUOUS |
| 75 | 760 | 2 min | 8° C./s | CONTINUOUS |
| 76 | 700 | 16 h | FC | BATCH |
| 77 | 700 | 16 h | FC | BATCH |
| 78 | 720 | 10 h | FC | BATCH |
| 79 | 720 | 10 h | FC | BATCH |
| 80 | 800 | 2 min | 8° C./s | CONTINUOUS |
| 81 | 800 | 2 min | 8° C./s | CONTINUOUS |
| 82 | 800 | 2 min | FC | BATCH |
| 83 | 800 | 2 min | FC | BATCH |
| 84 | 800 | 2 min | 8° C./s | CONTINUOUS |
| 85 | 840 | 2 min | 8° C./s | CONTINUOUS |
| 86 | 780 | 2 min | 8° C./s | CONTINUOUS |
| 87 | 780 | 2 min | 8° C./s | CONTINUOUS |
| 88 | 780 | 2 min | 8° C./s | CONTINUOUS |
| 89 | 780 | 2 min | 8° C./s | CONTINUOUS |
| 90 | 780 | 2 min | 8° C./s | CONTINUOUS |
| 91 | 780 | 2 min | 8° C./s | CONTINUOUS |
| 92 | 780 | 2 min | 8° C./s | CONTINUOUS |
| 93 | 780 | 2 min | 8° C./s | CONTINUOUS |
| 94 | 780 | 2 min | 8° C./s | CONTINUOUS |
| 95 | 780 | 2 min | 8° C./s | CONTINUOUS |
| 96 | 800 | 2 min | 8° C./s | CONTINUOUS |
| 97 | 800 | 2 min | 8° C./s | CONTINUOUS |

TABLE 7

| No. | GRAIN SIZE (μm) | α PHASE RATIO (%) | β PHASE RATIO (%) | INTERMETALLIC COMPOUND (%) | PROOF STRESS (MPa) | ELONGATION (%) | BONDING IN BATCH |
|---|---|---|---|---|---|---|---|
| 1 | 28 | 99.7 | 0 | 0.3 | 246 | 43 | ○ |
| 2 | 49 | 99.8 | 0 | 0.2 | 205 | 49 | — |

TABLE 7-continued

| | | | | | | | |
|---|---|---|---|---|---|---|---|
| 3 | 45 | 99.8 | 0 | 0.2 | 224 | 51 | — |
| 4 | 126 | 99.6 | 0 | 0.4 | 190 | 48 | — |
| 5 | 88 | 99.7 | 0 | 0.3 | 210 | 49 | — |
| 6 | 66 | 99.7 | 0.1 | 0.2 | 200 | 51 | ○ |
| 7 | 65 | 99.8 | 0 | 0.2 | 217 | 49 | ○ |
| 8 | 59 | 99.5 | 0.1 | 0.4 | 205 | 49 | ○ |
| 9 | 61 | 99.3 | 0.1 | 0.6 | 217 | 47 | ○ |
| 10 | 32 | 99.5 | 0 | 0.5 | 210 | 49 | — |
| 11 | 34 | 99.5 | 0.1 | 0.4 | 218 | 48 | — |
| 12 | 38 | 97.9 | 1.9 | 0.2 | 211 | 47 | — |
| 13 | 36 | 97.4 | 2.5 | 0.1 | 219 | 49 | — |
| 14 | 13 | 98.3 | 0.1 | 1.6 | 233 | 39 | ○ |
| 15 | 17 | 98.2 | 0.1 | 1.7 | 235 | 40 | ○ |
| 16 | 129 | 98 | 0.2 | 1.8 | — | — | x |
| 17 | 128 | 98 | 0.1 | 1.9 | — | — | x |
| 18 | 10 | 99.1 | 0 | 0.9 | 249 | 37 | ○ |
| 19 | 12 | 98.8 | 0 | 1.2 | 260 | 36 | ○ |
| 20 | 39 | 99.8 | 0 | 0.2 | 218 | 41 | — |
| 21 | 34 | 99.9 | 0 | 0.1 | 217 | 41 | — |
| 22 | 9 | 98.4 | 0 | 1.6 | 254 | 34 | ○ |
| 23 | 11 | 98.5 | 0 | 1.5 | 255 | 32 | ○ |
| 24 | 10 | 98.6 | 0 | 1.4 | 264 | 36 | ○ |
| 25 | 9 | 98.2 | 0 | 1.8 | 258 | 35 | ○ |
| 26 | 14 | 98.7 | 0 | 1.3 | 223 | 40 | — |
| 27 | 13 | 98.6 | 0.6 | 0.8 | 234 | 39 | — |
| 28 | 26 | 99.6 | 0.2 | 0.2 | 254 | 38 | — |
| 29 | 21 | 99.5 | 0.3 | 0.2 | 250 | 41 | — |
| 30 | 19 | 99.8 | 0 | 0.2 | 234 | 41 | — |

| No. | SURFACE STATE | FORMULA (2) (μm) | Δ0.2% PROOF STRESS (MPa) | SURFACE AFTER WORKING | DETERMINATION ON FORMULA (2) | CLASSIFICATION |
|---|---|---|---|---|---|---|
| 1 | ○ | 9.46 | 7 | ○ | 18.54 | INVENTION |
| 2 | ○ | 30.93 | 23 | ○ | 18.07 | COMPARATIVE |
| 3 | ○ | 30.93 | 25 | ○ | 14.07 | COMPARATIVE |
| 4 | ○ | 30.93 | 7 | x | 95.07 | COMPARATIVE |
| 5 | ○ | 19.61 | 9 | x | 68.39 | COMPARATIVE |
| 6 | ○ | 30.93 | 13 | ○ | 35.07 | COMPARATIVE |
| 7 | ○ | 30.93 | 30 | ○ | 34.07 | COMPARATIVE |
| 8 | ○ | 30.93 | 13 | ○ | 28.07 | COMPARATIVE |
| 9 | ○ | 19.61 | 27 | ○ | 41.39 | COMPARATIVE |
| 10 | ○ | 30.93 | 32 | ○ | 1.07 | COMPARATIVE |
| 11 | ○ | 30.93 | 31 | ○ | 3.07 | COMPARATIVE |
| 12 | ○ | 30.93 | 27 | ○ | 7.07 | COMPARATIVE |
| 13 | ○ | 19.61 | 26 | ○ | 16.39 | COMPARATIVE |
| 14 | ○ | 30.93 | 41 | ○ | −17.93 | COMPARATIVE |
| 15 | ○ | 30.93 | 46 | ○ | −13.93 | COMPARATIVE |
| 16 | — | 30.93 | — | — | 98.07 | COMPARATIVE |
| 17 | — | 19.61 | — | — | 108.39 | COMPARATIVE |
| 18 | ○ | 30.93 | 41 | ○ | −20.93 | COMPARATIVE |
| 19 | ○ | 30.93 | 38 | ○ | −18.93 | COMPARATIVE |
| 20 | ○ | 30.93 | 20 | ○ | 8.07 | COMPARATIVE |
| 21 | ○ | 19.61 | 18 | ○ | 14.39 | COMPARATIVE |
| 22 | ○ | 30.93 | 47 | ○ | −21.93 | COMPARATIVE |
| 23 | ○ | 30.93 | 44 | ○ | −19.93 | COMPARATIVE |
| 24 | ○ | 30.93 | 32 | ○ | −20.93 | COMPARATIVE |
| 25 | ○ | 19.61 | 34 | ○ | −10.61 | COMPARATIVE |
| 26 | ○ | 32.38 | 29 | ○ | −18.38 | COMPARATIVE |
| 27 | ○ | 35.47 | 15 | ○ | −22.47 | COMPARATIVE |
| 28 | ○ | 29.56 | 8 | ○ | −3.56 | COMPARATIVE |
| 29 | ○ | 21.48 | 9 | ○ | −0.48 | COMPARATIVE |
| 30 | ○ | 32.38 | 18 | ○ | −13.38 | COMPARATIVE |

TABLE 8

| No. | GRAIN SIZE (μm) | α PHASE RATIO (%) | β PHASE RATIO (%) | INTERMETALLIC COMPOUND (%) | PROOF STRESS (MPa) | ELONGATION (%) | BONDING IN BATCH |
|---|---|---|---|---|---|---|---|
| 31 | 18 | 99.9 | 0 | 0.1 | 241 | 40 | — |
| 32 | 18 | 99.8 | 0 | 0.2 | 239 | 41 | — |
| 33 | 15 | 99.7 | 0 | 0.3 | 237 | 38 | — |
| 34 | 33 | 99.7 | 0.1 | 0.2 | 236 | 45 | ○ |
| 35 | 36 | 99.9 | 0 | 0.1 | 255 | 44 | ○ |

TABLE 8-continued

| | | | | | | | |
|---|---|---|---|---|---|---|---|
| 36 | 32 | 99.9 | 0 | 0.1 | 240 | 45 | ○ |
| 37 | 31 | 99.7 | 0 | 0.3 | 252 | 43 | ○ |
| 38 | 8 | 97.8 | 0.1 | 2.1 | 271 | 37 | ○ |
| 39 | 10 | 97.5 | 0.1 | 2.4 | 265 | 36 | ○ |
| 40 | 66 | — | — | — | 247 | 40 | x |
| 41 | 64 | — | — | — | 250 | 38 | x |
| 42 | 5 | 98.7 | 0 | 1.3 | 255 | 37 | ○ |
| 43 | 6 | 98.5 | 0 | 1.5 | 254 | 36 | ○ |
| 44 | 26 | 99.8 | 0 | 0.2 | 251 | 40 | — |
| 45 | 21 | 99.9 | 0 | 0.1 | 249 | 41 | — |
| 46 | 7 | 98.4 | 0 | 1.6 | 288 | 32 | ○ |
| 47 | 6 | 98.3 | 0 | 1.7 | 291 | 35 | ○ |
| 48 | 6 | 98.5 | 0 | 1.5 | 284 | 33 | ○ |
| 49 | 7 | 98.4 | 0 | 1.6 | 274 | 34 | ○ |
| 50 | 84 | 99.7 | 0.2 | 0.1 | 200 | 51 | ○ |
| 51 | 88 | 99.8 | 0.1 | 0.1 | 203 | 48 | o |
| 52 | 16 | 98.6 | 1.2 | 0.2 | 231 | 47 | — |
| 53 | 14 | 98.8 | 1.1 | 0.1 | 223 | 47 | — |
| 54 | 26 | 99.3 | 0.5 | 0.2 | 233 | 48 | — |
| 55 | 22 | 98.9 | 0.8 | 0.3 | 238 | 47 | — |
| 56 | 69 | 99 | 0.9 | 0.1 | 231 | 49 | ○ |
| 57 | 18 | 99.5 | 0 | 0.5 | 219 | 46 | ○ |
| 58 | 17 | 99.6 | 0 | 0.4 | 217 | 44 | ○ |
| 59 | 16 | 99.5 | 0 | 0.5 | 218 | 44 | ○ |
| 60 | 34 | 99.8 | 0.1 | 0.1 | 222 | 46 | ○ |

| No. | SURFACE STATE | FORMULA (2) (μm) | Δ0.2% PROOF STRESS (MPa) | SURFACE AFTER WORKING | DETERMINATION ON FORMULA (2) | CLASSIFICATION |
|---|---|---|---|---|---|---|
| 31 | ○ | 35.47 | 21 | ○ | −17.47 | COMPARATIVE |
| 32 | ○ | 29.56 | 17 | ○ | −11.56 | COMPARATIVE |
| 33 | ○ | 21.48 | 19 | ○ | −6.48 | COMPARATIVE |
| 34 | ○ | 32.38 | 8 | ○ | 0.62 | INVENTION |
| 35 | ○ | 35.47 | 7 | ○ | 0.53 | INVENTION |
| 36 | ○ | 29.56 | 9 | ○ | 2.44 | INVENTION |
| 37 | ○ | 21.48 | 7 | ○ | 9.52 | INVENTION |
| 38 | ○ | 32.38 | 24 | ○ | −24.38 | COMPARATIVE |
| 39 | ○ | 35.47 | 19 | ○ | −25.47 | COMPARATIVE |
| 40 | — | 29.56 | — | — | 36.44 | COMPARATIVE |
| 41 | — | 21.48 | — | — | 42.52 | COMPARATIVE |
| 42 | ○ | 32.38 | 29 | ○ | −27.38 | COMPARATIVE |
| 43 | ○ | 35.47 | 28 | ○ | −29.47 | COMPARATIVE |
| 44 | ○ | 29.56 | 7 | ○ | −3.56 | COMPARATIVE |
| 45 | ○ | 21.48 | 8 | ○ | −0.48 | COMPARATIVE |
| 46 | ○ | 32.38 | 21 | ○ | −25.38 | COMPARATIVE |
| 47 | ○ | 35.47 | 22 | ○ | −29.47 | COMPARATIVE |
| 48 | ○ | 29.56 | 23 | ○ | −23.56 | COMPARATIVE |
| 49 | ○ | 21.48 | 18 | ○ | −14.48 | COMPARATIVE |
| 50 | ○ | 3.17 | 17 | x | 80.83 | COMPARATIVE |
| 51 | ○ | 3.17 | 16 | x | 84.83 | COMPARATIVE |
| 52 | ○ | 3.17 | 37 | ○ | 12.83 | COMPARATIVE |
| 53 | ○ | 3.17 | 33 | ○ | 10.83 | COMPARATIVE |
| 54 | ○ | 3.17 | 26 | ○ | 22.83 | COMPARATIVE |
| 55 | ○ | 3.17 | 22 | ○ | 18.83 | COMPARATIVE |
| 56 | ○ | 3.17 | 19 | ○ | 65.83 | COMPARATIVE |
| 57 | ○ | 37.12 | 31 | ○ | −19.12 | COMPARATIVE |
| 58 | ○ | 21.48 | 29 | ○ | −4.48 | COMPARATIVE |
| 59 | ○ | 22.48 | 33 | ○ | −6.48 | COMPARATIVE |
| 60 | ○ | 32.38 | 8 | ○ | 1.62 | INVENTION |

TABLE 9

| No. | GRAIN SIZE (μm) | α PHASE RATIO (%) | β PHASE RATIO (%) | INTERMETALLIC COMPOUND (%) | PROOF STRESS (MPa) | ELONGATION (%) | BONDING IN BATCH |
|---|---|---|---|---|---|---|---|
| 61 | 33 | 99.8 | 0.1 | 0.1 | 249 | 43 | ○ |
| 62 | 30 | 99.6 | 0.1 | 0.3 | 246 | 44 | ○ |
| 63 | 23 | 99.6 | 0.2 | 0.2 | 237 | 40 | — |
| 64 | 18 | 99.7 | 0.2 | 0.1 | 235 | 40 | — |
| 65 | 21 | 99.7 | 0.1 | 0.2 | 235 | 40 | — |
| 66 | 10 | 98.3 | 0.1 | 1.6 | 265 | 34 | ○ |
| 67 | 13 | 98.5 | 0 | 1.5 | 271 | 36 | ○ |
| 68 | 54 | — | — | — | — | — | x |
| 69 | 34 | 99.6 | 0.2 | 0.2 | 206 | 47 | ○ |

TABLE 9-continued

| | | | | | | | |
|---|---|---|---|---|---|---|---|
| 70 | 31 | 99.7 | 0.2 | 0.1 | 226 | 45 | ○ |
| 71 | 32 | 99.7 | 0.2 | 0.1 | 219 | 45 | ○ |
| 72 | 14 | 99.5 | 0.4 | 0.1 | 257 | 43 | — |
| 73 | 16 | 99.5 | 0.3 | 0.2 | 265 | 42 | — |
| 74 | 13 | 99.2 | 0.4 | 0.4 | 266 | 42 | — |
| 75 | 14 | 99.1 | 0.6 | 0.3 | 259 | 43 | — |
| 76 | 21 | 98.3 | 0.1 | 1.6 | 249 | 40 | ○ |
| 77 | 23 | 98.3 | 0.2 | 1.5 | 251 | 39 | ○ |
| 78 | 51 | 98.1 | 0.1 | 1.8 | 247 | 38 | ○ |
| 79 | 49 | 98.2 | 0.1 | 1.7 | 246 | 40 | ○ |
| 80 | 22 | 99.2 | 0.2 | 0.6 | 276 | 43 | ○ |
| 81 | 8 | 99.5 | 0.1 | 0.4 | 288 | 34 | ○ |
| 82 | 23 | 98.3 | 0.1 | 1.6 | 274 | 40 | x |
| 83 | 26 | 98.6 | 0.1 | 1.3 | 271 | 39 | x |
| 84 | 29 | 99.5 | 0 | 0.5 | 277 | 42 | Δ |
| 85 | 39 | 94.1 | 5.1 | 0.8 | 265 | 40 | ○ |
| 86 | 34 | 99.5 | 0.4 | 0.1 | 244 | 43 | ○ |
| 87 | 33 | 99.2 | 0.6 | 0.2 | 249 | 45 | ○ |
| 88 | 29 | 99.6 | 0.3 | 0.1 | 258 | 44 | ○ |
| 89 | 31 | 99.6 | 0.4 | 0 | 255 | 46 | ○ |
| 90 | 28 | 99.8 | 0.1 | 0.1 | 254 | 43 | ○ |
| 91 | 28 | 99.7 | 0.2 | 0.1 | 253 | 44 | ○ |
| 92 | 29 | 99.9 | 0.1 | 0 | 247 | 45 | ○ |
| 93 | 27 | 99.4 | 0.6 | 0 | 256 | 43 | ○ |
| 94 | 32 | 99.8 | 0.1 | 0.1 | 247 | 44 | ○ |
| 95 | 31 | 99.6 | 0.1 | 0.3 | 247 | 44 | ○ |
| 96 | 25 | 99.1 | 0.5 | 0.4 | 283 | 42 | ○ |
| 97 | 26 | 99.3 | 0.3 | 0.4 | 261 | 44 | ○ |

| No. | SURFACE STATE | FORMULA (2) (μm) | Δ0.2% PROOF STRESS (MPa) | SURFACE AFTER WORKING | DETERMINATION ON FORMULA (2) | CLASSIFICATION |
|---|---|---|---|---|---|---|
| 61 | ○ | 21.48 | 6 | ○ | 11.52 | INVENTION |
| 62 | ○ | 23.53 | 6 | ○ | 6.47 | INVENTION |
| 63 | ○ | 32.38 | 10 | ○ | −9.38 | COMPARATIVE |
| 64 | ○ | 21.48 | 13 | ○ | −3.48 | COMPARATIVE |
| 65 | ○ | 23.53 | 10 | ○ | −2.53 | COMPARATIVE |
| 66 | ○ | 32.38 | 18 | ○ | −22.38 | COMPARATIVE |
| 67 | ○ | 21.48 | 14 | ○ | −8.48 | COMPARATIVE |
| 68 | — | 23.53 | — | — | 30.47 | COMPARATIVE |
| 69 | ○ | 37.12 | 30 | ○ | −3.12 | COMPARATIVE |
| 70 | ○ | 21.48 | 21 | ○ | 9.52 | COMPARATIVE |
| 71 | ○ | 22.48 | 16 | ○ | 9.52 | COMPARATIVE |
| 72 | ○ | 5.47 | 17 | ○ | 8.53 | COMPARATIVE |
| 73 | ○ | 9.46 | 16 | ○ | 6.54 | COMPARATIVE |
| 74 | ○ | 5.47 | 18 | ○ | 7.53 | COMPARATIVE |
| 75 | ○ | 9.46 | 15 | ○ | 4.54 | COMPARATIVE |
| 76 | ○ | 5.47 | 8 | ○ | 15.53 | COMPARATIVE |
| 77 | ○ | 9.46 | 9 | ○ | 13.54 | COMPARATIVE |
| 78 | ○ | 5.47 | 6 | ○ | 45.53 | COMPARATIVE |
| 79 | ○ | 9.46 | 5 | ○ | 39.54 | COMPARATIVE |
| 80 | ○ | 5.47 | 9 | ○ | 16.53 | INVENTION |
| 81 | ○ | 9.46 | 14 | ○ | −1.46 | COMPARATIVE |
| 82 | — | 9.46 | 7 | — | 13.54 | COMPARATIVE |
| 83 | — | 9.46 | 7 | — | 16.54 | COMPARATIVE |
| 84 | x | 9.46 | 6 | x | 19.54 | COMPARATIVE |
| 85 | ○ | 35.47 | 8 | ○ | 3.53 | COMPARATIVE |
| 86 | ○ | 6.57 | 8 | ○ | 27.43 | INVENTION |
| 87 | ○ | 11.35 | 6 | ○ | 21.65 | INVENTION |
| 88 | ○ | 13.01 | 7 | ○ | 15.99 | INVENTION |
| 89 | ○ | 11.88 | 4 | ○ | 19.12 | INVENTION |
| 90 | ○ | 10.84 | 8 | ○ | 17.16 | INVENTION |
| 91 | ○ | 13.01 | 4 | ○ | 14.99 | INVENTION |
| 92 | ○ | 12.43 | 6 | ○ | 16.57 | INVENTION |
| 93 | ○ | 15.61 | 5 | ○ | 11.39 | INVENTION |
| 94 | ○ | 12.43 | 8 | ○ | 19.57 | INVENTION |
| 95 | ○ | 9.03 | 8 | ○ | 21.97 | INVENTION |
| 96 | ○ | 8.25 | 7 | ○ | 16.75 | INVENTION |
| 97 | ○ | 2.30 | 8 | ○ | 23.70 | INVENTION |

INDUSTRIAL APPLICABILITY

The titanium sheet of the present invention is suitably used in, for example, heat exchangers, welded pipes, motorcycle exhaust systems such as mufflers, building materials, and the like.

What is claimed is:

1. A titanium sheet consisting of the following chemical components in mass %:

Cu: 0.70 to 1.50%,

Cr: 0 to 0.40%,

Mn: 0 to 0.50%,

Si: 0.10 to 0.30%,
O: 0 to 0.10%,
Fe: 0 to 0.06%,
N: 0 to 0.03%,
C: 0 to 0.08%,
H: 0 to 0.013%,
other impurity elements: 0 to 0.1% each, with a total amount of the other impurity elements being 0.3% or less, and
the balance: Ti,
wherein A value defined by Formula (1) below is 1.15 to 2.5 mass %, and
the titanium sheet having a metal microstructure in which,
an area fraction of an α phase is 95% or more,
an area fraction of a β phase is 5% or less, and
an area fraction of an intermetallic compound is 1% or less,
wherein an average crystal grain size D (μm) of the α phase is 20 to 70 μm and satisfies Formula (2) below, $$A=[Cu]+0.98\,[Cr]+1.16\,[Mn]+3.4\,[Si] \quad \text{Formula (1)}$$

$$D\,[\mu m]\geq 0.8064\times e^{45.588\,[O]} \quad \text{Formula (2),}$$

where e is the base of a natural logarithm, and
the titanium sheet having a fracture elongation of 42% or more in a state of a flat tensile specimen whose parallel region has a width of 6.25 mm, in which an original gauge length is 25 mm, and whose thickness is not changed from the sheet thickness.

2. The titanium sheet according to claim 1, wherein, in the metal microstructure, a total of the area fractions of the α phase, the β phase, and the intermetallic compound is 100%.

3. The titanium sheet according to claim 1, wherein the intermetallic compound includes a Ti—Si-based intermetallic compound and a Ti—Cu-based intermetallic compound.

4. The titanium sheet according to claim 2, wherein the intermetallic compound includes a Ti—Si-based intermetallic compound and a Ti—Cu-based intermetallic compound.

5. The titanium sheet according to claim 1, the titanium sheet having a sheet thickness of 0.3 to 1.5 mm and a 0.2% proof stress of 215 MPa or more.

6. The titanium sheet according to claim 2, the titanium sheet having a sheet thickness of 0.3 to 1.5 mm and a 0.2% proof stress of 215 MPa or more.

7. The titanium sheet according to claim 3, the titanium sheet having a sheet thickness of 0.3 to 1.5 mm and a 0.2% proof stress of 215 MPa or more.

8. The titanium sheet according to claim 4, the titanium sheet having a sheet thickness of 0.3 to 1.5 mm and a 0.2% proof stress of 215 MPa or more.

9. The titanium sheet according to claim 1, wherein A value defined by Formula (1) is 1.15 to 2.22 mass %.

10. The titanium sheet according to claim 1, wherein A value defined by Formula (1) is 1.15 to 2.15 mass %.

* * * * *